US010229688B2

(12) United States Patent
Abe

(10) Patent No.: US 10,229,688 B2
(45) Date of Patent: Mar. 12, 2019

(54) DATA COMPRESSION APPARATUS, COMPUTER-READABLE STORAGE MEDIUM HAVING STORED THEREIN DATA COMPRESSION PROGRAM, DATA COMPRESSION SYSTEM, DATA COMPRESSION METHOD, DATA DECOMPRESSION APPARATUS, DATA COMPRESSION/DECOMPRESSION APPARATUS, AND DATA STRUCTURE OF COMPRESSED DATA

(71) Applicant: NINTENDO CO., LTD., Kyoto (JP)

(72) Inventor: Tomokazu Abe, Kyoto (JP)

(73) Assignee: NINTENDO CO., LTD., Kyoto (JP)

( * ) Notice: Subject to any disclaimer, the term of this patent is extended or adjusted under 35 U.S.C. 154(b) by 389 days.

(21) Appl. No.: 14/684,796

(22) Filed: Apr. 13, 2015

(65) Prior Publication Data

US 2015/0221310 A1 Aug. 6, 2015

Related U.S. Application Data

(63) Continuation of application No. 13/598,826, filed on Aug. 30, 2012, now Pat. No. 9,031,852.

(30) Foreign Application Priority Data

Aug. 1, 2012 (JP) ..... 2012-170963

(51) Int. Cl.

| | |
|---|---|
| ***G10L 19/00*** | (2013.01) |
| ***G10L 19/02*** | (2013.01) |
| *G10L 19/035* | (2013.01) |

(52) U.S. Cl.

CPC ..... *G10L 19/00* (2013.01); *G10L 19/02* (2013.01); *G10L 19/035* (2013.01)

(58) Field of Classification Search

CPC ..... G10L 19/00
USPC ..... 704/500
See application file for complete search history.

(56) References Cited

U.S. PATENT DOCUMENTS

| | | | | |
|---|---|---|---|---|
| 5,294,925 A | | 3/1994 | Akagiri | |
| 5,737,718 A | | 4/1998 | Tsutsui | |
| 5,765,126 A | | 6/1998 | Tsutsui et al. | |
| 5,825,979 A | | 10/1998 | Tsutsui et al. | |
| 5,977,889 A | * | 11/1999 | Cohen | H03M 7/30 341/55 |
| 6,061,474 A | | 5/2000 | Kajiwara et al. | |
| 6,101,282 A | | 8/2000 | Hirabayashi et al. | |

(Continued)

FOREIGN PATENT DOCUMENTS

| | | |
|---|---|---|
| JP | 7-336232 | 12/1995 |
| JP | H09-37246 | 2/1997 |

(Continued)

*Primary Examiner* — Jakieda R Jackson
(74) *Attorney, Agent, or Firm* — Nixon & Vanderhye P.C.

(57) ABSTRACT

A data compression/decompression apparatus, for example, acquires sampling data obtained by sampling an audio signal with a predetermined period, and converts the sampling data into frequency domain data. The data compression/decompression apparatus divides a data sequence of the converted frequency domain data into a plurality of blocks such that the number of pieces of data included in each block is variable, and compresses each block.

23 Claims, 20 Drawing Sheets

(56) References Cited

U.S. PATENT DOCUMENTS

| | | | | |
|---|---|---|---|---|
| 7,453,378 | B2 * | 11/2008 | Narayanan | H03M 7/30 341/51 |
| 2002/0016161 | A1 * | 2/2002 | Dellien | G10L 19/00 455/403 |
| 2003/0086125 | A1 * | 5/2003 | Igarashi | H04N 1/4175 358/426.04 |
| 2007/0016412 | A1 | 1/2007 | Mehrotra et al. | |
| 2009/0281984 | A1 * | 11/2009 | Black | H04L 43/026 |
| 2010/0198603 | A1 | 8/2010 | Paranjpe | |
| 2010/0223237 | A1 * | 9/2010 | Mishra | G06F 9/30156 707/693 |
| 2011/0035227 | A1 | 2/2011 | Lee et al. | |
| 2011/0129162 | A1 * | 6/2011 | Kim | H04N 19/105 382/238 |
| 2014/0039902 | A1 | 2/2014 | Abe | |

FOREIGN PATENT DOCUMENTS

| | | |
|---|---|---|
| JP | H09-37262 | 2/1997 |
| JP | H09-093134 | 4/1997 |
| JP | 2003-219418 | 7/2003 |
| JP | 2005-151327 | 6/2005 |
| JP | 2008-107615 | 5/2008 |
| WO | 2009-048239 | 4/2009 |

* cited by examiner

FREQUENCY DOMAIN DATA SEQUENCE = {−1000.5、 −500.0、 −120.8、 0.01、 100、・・・} (n PIECES)

⇩

ABSOLUTE VALUE DATA SEQUENCE = { 1000.5、 500.0、 120.8、 0.01、 100、・・・} (n PIECES)

+

SIGN DATA SEQUENCE = { −1、 −1、 −1、 1、 1、・・・} (n PIECES)

(A) WHEN BLOCKS ARE DIVIDED

TOTAL SIZE OF TWO BLOCKS (A) = (H + BN) + {H + M (B + $\alpha$)} [BITS]

(B) WHEN BLOCKS ARE NOT DIVIDED (WHEN BLOCKS ARE INTEGRATED INTO ONE BLOCK)

SIZE OF ONE INTEGRATED BLOCK (B) = H + (N + M)(B + $\alpha$) [BITS]

(C) WHEN BLOCKS ARE DIVIDED

TOTAL SIZE OF TWO BLOCKS (C) = (H + BN) + {H + M (B − α)} [BITS]

(D) WHEN BLOCKS ARE NOT DIVIDED (WHEN BLOCKS ARE INTEGRATED INTO ONE BLOCK)

SIZE OF ONE INTEGRATED BLOCK (D) = H + (N + M) B [BITS]

DATA COMPRESSION APPARATUS, COMPUTER-READABLE STORAGE MEDIUM HAVING STORED THEREIN DATA COMPRESSION PROGRAM, DATA COMPRESSION SYSTEM, DATA COMPRESSION METHOD, DATA DECOMPRESSION APPARATUS, DATA COMPRESSION/DECOMPRESSION APPARATUS, AND DATA STRUCTURE OF COMPRESSED DATA

CROSS REFERENCE TO RELATED APPLICATION

This application is a continuation of application Ser. No. 13/598,826, filed Aug. 30, 2012, which claims priority to Japanese Patent Application No. 2012-170963, filed on Aug. 1, 2012, each of which is hereby incorporated by reference.

FIELD

The technique disclosed herein relates to a data compression apparatus, a computer-readable storage medium having stored therein a data compression program, a data compression system, a data compression method, a data decompression apparatus, a data compression/decompression apparatus, and the data structure of compressed data.

BACKGROUND AND SUMMARY

Conventionally, there is an apparatus that, for example, divides input music data on the basis of frequency ranges, and converts the divided signals into frequency domain data to encode it, thereby compressing the music data.

The conventional technique, however, divides a signal on the basis of fixed frequency ranges determined in advance, and encodes the divided signals. Thus, there is room for improvement in, for example, the efficiency of data compression.

Therefore, it is an object of an exemplary embodiment to provide a data compression technique that can improve the efficiency of data compression.

To achieve the above object, the exemplary embodiment employs the following configurations.

An exemplary embodiment is a data compression apparatus for compressing input compression target data to generate compressed data. The data compression apparatus includes a conversion unit, a block generation unit, and a compressed data generation unit. The conversion unit converts the compression target data into a plurality of pieces of frequency domain data. The block generation unit generates a plurality of blocks by, on the basis of the plurality of pieces of frequency domain data, dividing a data sequence in which the plurality of pieces of frequency domain data are arranged into a plurality of blocks such that separation positions of the blocks are variable. The compressed data generation unit generates the compressed data by compressing, on a block basis, the pieces of frequency domain data included in the blocks generated by the block generation unit.

On the basis of the above, it is possible to generate blocks such that the separation positions of a data sequence is variable, and compress the data on a block basis. This makes it possible to, for example, efficiently compress data.

In addition, in another configuration, the block generation unit may generate the plurality of blocks on the basis of the characteristics of the plurality of pieces of frequency domain data.

On the basis of the above, it is possible to generate a plurality of blocks on the basis of the characteristics of a plurality of pieces of frequency domain data. Here, "generate a plurality of blocks on the basis of the characteristics of a plurality of pieces of frequency domain data" means the generation of a plurality of blocks on the basis of the properties of pieces of data obtained by reading the pieces of data, not the generation of a plurality of blocks with a pattern determined in advance.

In addition, in another configuration, the block generation unit may generate the plurality of blocks on the basis of the characteristics of the plurality of pieces of frequency domain data with respect to a certain number of pieces of the compression target data.

On the basis of the above, it is possible to generate a plurality of blocks on the basis of, with respect to a frame including a certain number of pieces of compression target data, the characteristics of a plurality of pieces of frequency domain data included in the frame. This makes it possible to vary the separation positions of the blocks depending on the frame.

In addition, in another configuration, the block generation unit may generate the plurality of blocks on the basis of a similarity between the plurality of pieces of frequency domain data.

On the basis of the above, it is possible to generate a plurality of blocks on the basis of a similarity between a pieces of data, and compress each block. Here, the similarity indicates that the pieces of data are similar from a certain point of view, and indicates, for example, that the values of the pieces of data are the same or the difference between the values is a predetermined value or less, or that the numbers of bits for representing the pieces of data are the same or are in a predetermined range.

In addition, in another configuration, the block generation unit may generate the plurality of blocks such that, in the data sequence of the plurality of pieces of frequency domain data, a plurality of pieces of data having different values but having a similarity are included in one of the blocks.

On the basis of the above, it is possible to include pieces of data having different values but having a similarity in the same block to generate the block.

In addition, in another configuration, the block generation unit may categorize the pieces of frequency domain data in accordance with values thereof, and may generate the plurality of blocks on the basis of the categories.

On the basis of the above, it is possible to categorize pieces of frequency domain data, and generate blocks in accordance with the categories. This makes it possible to categorize pieces of data into some types, and generate blocks on the basis of the types.

In addition, in another configuration, the block generation unit may generate the plurality of blocks so as to include any of the pieces of frequency domain data of the same category in the same block.

On the basis of the above, it is possible to include pieces of data belonging to the same category in one block. This makes it possible to generate blocks more suitable for data compression, and compress the blocks.

In addition, in another configuration, even when one of the pieces of frequency domain data and one of the blocks belong to different categories, if the piece of data and the block satisfy a predetermined condition, the block generation unit may include the piece of data in the block.

On the basis of the above, even when a piece of data and a block belong to different categories, if the piece of data and the block satisfy a predetermined condition, it is possible to include the pieces of data in the block. This makes it possible to, for example, prevent an increase in the number of blocks, and therefore prevent an increase in the data size of the entire data when compressed. Here, the predetermined condition may be a condition determined taking into account the case where the piece of data is included in the block and the case where the piece of data is not included in the block.

In addition, in another configuration, the block generation unit may generate the plurality of blocks on the basis of a continuity between the plurality of pieces of frequency domain data when arranged.

On the basis of the above, it is possible to generate blocks on the basis of a continuity between pieces of data. Here, the continuity between pieces of data may be, for example, the fact that the values of a piece of data and a piece of data adjacent thereto or at a position in a predetermined range therefrom are continuous (the difference between the pieces of data is a predetermined value or less).

In addition, in another configuration, the block generation unit may generate the plurality of blocks on the basis of the number of bits for representing each of the pieces of frequency domain data.

On the basis of the above, it is possible to generate blocks on the basis of the number of bits of each piece of data. This makes it possible to generate blocks and compress data by a simple method.

In addition, in another configuration, the block generation unit may assemble, in one of the blocks, any of the pieces of frequency domain data having the same number of bits for representing each of the pieces of frequency domain data. The compressed data generation unit may compress the pieces of frequency domain data included in each block by removing unnecessary bits so as to leave bits for representing each piece of data included in the block.

On the basis of the above, it is possible to efficiently compress data by a simple method such as assembling pieces of data having the same number of bits, and removing unnecessary bits. Further, it is also possible to accurately reconstruct data before being compressed.

In addition, in another configuration, even when one of the pieces of frequency domain data and one of the blocks have different numbers of bits for representing each of the pieces of frequency domain data, if the piece of data and the block satisfy a predetermined condition, the block generation unit may include the piece of data in the block.

On the basis of the above, even when a piece of data and a block have different numbers of bits, if the pieces of data and the block satisfy a predetermined condition, it is possible to include the pieces of data in the block. This makes it possible to, for example, prevent an increase in the number of blocks, and therefore prevent an increase in the data size of the entire data when compressed.

In addition, in another configuration, taking into account a size of the compressed data compressed when one of the blocks is divided and the size of the compressed data compressed when the block is not divided, the block generation unit may determine whether or not the block is to be divided, and if the block generation unit has determined that the block is to be divided, the block generation unit may divide the block.

On the basis of the above, it is possible to, taking into account the size of data when a block is divided and the size of the data when the block is not divided, determine whether or not the block is to be divided. This makes it possible to generate blocks by a manner of dividing a block that results in a small data size, and compress the blocks, which makes it possible to increase the compression ratio.

In addition, in another configuration, if a size of the data sequence compressed when separated at a particular position is smaller than the size of the data sequence compressed when separated at a position different from the particular position, the block generation unit may separate the data sequence at the particular position.

On the basis of the above, it is possible to generate blocks by separating data at a separation position that results in a higher compression ratio when the data is compressed, and compress the blocks.

In addition, in another configuration, the block generation unit may generate, on a block basis, decompression information used to decompress the blocks.

On the basis of the above, it is possible to generate decompression information on a block basis, and decompress each block using the decompression information.

In addition, in another configuration, the decompression information may be information common to the pieces of frequency domain data included in each block.

On the basis of the above, it is possible to generate information common to pieces of data as decompression information, and decompress the compressed data using the information.

In addition, in another configuration, the block generation unit may generate the plurality of blocks on the basis of a size of the decompression information.

On the basis of the above, it is possible to generate blocks, taking into account the size of decompression information used to decompress compressed data.

In addition, in another configuration, if a size of one of the blocks when the block is not divided is larger than a size of two blocks that are obtained by dividing the block and include the decompression information increased when the block is divided, the block generation unit may divide the block.

On the basis of the above, it is possible to, taking into account decompression information added when a block is divided, determine whether or not the block is to be divided. This makes it possible to divide a block by a method that results in a smaller size, which makes it possible to increase the compression ratio of the entire data.

In addition, in another configuration, the block generation unit may divide the plurality of pieces of frequency domain data into the plurality of blocks such that, if the plurality of pieces of frequency domain data are arranged in accordance with frequencies thereof, separation positions of the frequencies are variable.

On the basis of the above, it is possible to generate variable blocks, instead of generating fixed blocks in accordance with frequency ranges, and compress the blocks. This makes it possible to efficiently compress data.

In addition, in another configuration, the block generation unit may include a determination unit and a generation unit. The determination unit determines whether or not one of the pieces of frequency domain data arranged in the data sequence is to be included in a current block. The generation unit, if the determination unit has determined that the piece of frequency domain data is to be included in the current block, includes the piece of frequency domain data in the current block, and, if the determination unit has determined that the piece of frequency domain data is not to be included in the current block, generates a subsequent block and includes the piece of frequency domain data in the subsequent block.

On the basis of the above, it is possible to generate blocks by processing pieces of frequency domain data in order.

Another embodiment is a data compression apparatus for compressing input compression target data to generate compressed data, the data compression apparatus. The data compression apparatus includes a conversion unit, a block generation unit, and a compressed data generation unit. The conversion unit converts the compression target data into a plurality of pieces of frequency domain data. The block generation unit, on the basis of characteristics of the plurality of pieces of frequency domain data, generates a plurality of blocks such that the number of the pieces of frequency domain data included in each block is variable. The compressed data generation unit generates the compressed data by compressing, on a block basis, the pieces of frequency domain data included in the blocks generated by the block generation unit.

Another embodiment is a data decompression apparatus for decompressing compressed data to generate decompressed data. The compressed data includes a plurality of blocks having a plurality of pieces of compressed frequency domain data, and information for specifying the number of the pieces of compressed frequency domain data included in each block. The data decompression apparatus includes an extraction unit and a decompression unit. The extraction unit extracts each block included in the compressed data. The decompression unit, on the basis of the information for specifying the number of the pieces of compressed frequency domain data included in the block, decompresses the compressed data on a block basis to generate a plurality of pieces of frequency domain data, to thereby generate the decompressed data.

Another embodiment is a data compression/decompression system for compressing input data to generate compressed data and decompressing the compressed data, the data compression/decompression system. The data compression/decompression system includes a conversion unit, a block generation unit, a compressed data generation unit, an extraction unit, and a decompression unit. The conversion unit converts the input data into a plurality of pieces of frequency domain data. The block generation unit generates a plurality of blocks by, on the basis of the plurality of pieces of frequency domain data, dividing a data sequence in which the plurality of pieces of frequency domain data are arranged into a plurality of blocks such that separation positions of the blocks are variable. The compressed data generation unit generates the compressed data by compressing, on a block basis, the pieces of frequency domain data included in the blocks generated by the block generation unit. The extraction unit extracts each block included in the compressed data. The decompression unit decompresses the compressed data by decompressing the compressed data on a block basis to generate the plurality of pieces of frequency domain data.

Another embodiment is a data structure of compressed data obtained by compressing compression target data. The compressed data includes a plurality of blocks. Each of the plurality of blocks includes a region containing a plurality of pieces of compressed data, and a block header region containing information for decompressing the pieces of compressed data.

The data structure may further include a frame header region including information for specifying information regarding the block header region.

It should be noted that another embodiment may be a data compression program to be executed by the data compression apparatus, or may be a data compression system including a plurality of apparatuses. Alternatively, another embodiment may be a data compression method. Yet alternatively, another embodiment may be a data decompression program to be executed by the data decompression apparatus, or may be a data decompression system, or may be a data decompression method.

The exemplary embodiment makes it possible to generate blocks such that the number of pieces of data included in the blocks are variable, and compress the pieces of data on a block basis.

These and other objects, features, aspects and advantages of the exemplary embodiment will become more apparent from the following detailed description of the exemplary embodiment when taken in conjunction with the accompanying drawings.

DETAILED DESCRIPTION OF NON-LIMITING EXAMPLE EMBODIMENTS (Configuration of Data Compression/Decompression Apparatus)

With reference to the drawings, a data compression/decompression apparatus 10 according to an exemplary embodiment is described below. The data compression/decompression apparatus 10, for example, receives an input of an audio signal (or an image signal), converts the audio signal into a digital signal, compresses the digital signal, and stores data of the compressed digital signal. Further, the data compression/decompression apparatus 10 decompresses the stored compressed data, converts the decompressed data into an audio signal, and outputs the audio signal. A description is given below of the case where a sound such as a human voice (or music or the like) is compressed and decompressed using the data compression/decompression apparatus 10.

Figure 1:
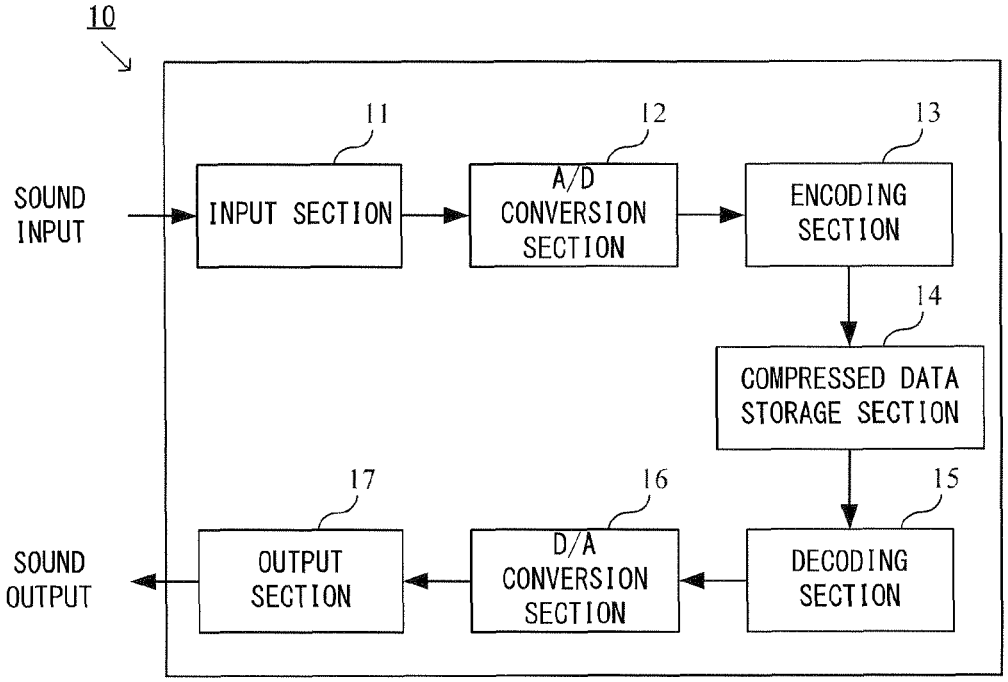
FIG. 1 is a block diagram showing a non-limiting example of the functional configuration of a data compression/decompression apparatus 10.

FIG. 1 is a block diagram showing the functional configuration of the data compression/decompression apparatus 10. As shown in FIG. 1, the data compression/decompression apparatus 10 includes an input section 11, an A/D conversion section 12, an encoding section 13, a compressed data storage section 14, a decoding section 15, a D/A conversion section 16, and an output section 17.

The input section 11 is, for example, a microphone, and receives an input of an audio signal of a sound such as a human voice. The A/D conversion section 12 receives an analog signal from the input section 11, and converts the analog signal into a digital signal. The A/D conversion section 12 samples an analog audio signal with a predetermined sampling period, and temporarily stores the sampling data obtained by sampling the audio signal in a storage section such as a memory. The sampling frequency may be, for example, 44 kHz, or may be any other frequency, or may be variable.

The encoding section 13 acquires the sampling data from the A/D conversion section 12, and performs a predetermined process on the sampling data. Specifically, the encoding section 13 converts the acquired sampling data into frequency domain data, and compresses the converted frequency domain data to generate compressed data obtained by compressing the audio signal.

The compressed data storage section 14 stores the compressed data generated by the encoding section 13. The compressed data storage section 14 is composed, for example, of a non-volatile memory.

The decoding section 15 reads the compressed data from the compressed data storage section 14, and decompresses the compressed data. The D/A conversion section 16 converts the decompressed data into an analog signal, and outputs the analog signal to the output section 17. The output section 17 is, for example, a loudspeaker. The output section 17 receives the analog signal from the D/A conversion section 16, and outputs the analog signal as a sound.

It should be noted that the data compression/decompression apparatus 10 has a hardware configuration including a CPU, a main memory, a non-volatile memory, a microphone, a loudspeaker, and the like. For example, the non-volatile memory stores a program for performing a data compression process (described later) performed by the encoding section 13, and a data decompression process (described later) performed by the decoding section 15. Then, the program is loaded into the main memory, and causes the CPU to function as the above components. Further, the data compression/decompression apparatus 10 may include a dedicated circuit that functions as some or all of the above components. That is, the above components can be achieved by software, hardware, or a combination of software and hardware.

It should be noted that the configuration of the data compression/decompression apparatus 10 is merely illustrative, and processes described later (an encoding process and a decoding process) may be performed by any apparatus. For example, the data compression/decompression apparatus 10 may include a plurality of physically separated apparatuses. For example, a data compression/decompression apparatus (system) may be achieved by the connection, via a network, between a plurality of apparatuses installed at physically separated locations. For example, the encoding section 13 and the decoding section 15 may be physically separated from each other, so that compressed data encoded by the encoding section 13 is transmitted in a streaming format to the decoding section 15, and decoded by the decoding section 15.

(Overview of Data Compression Process)

Figure 2:
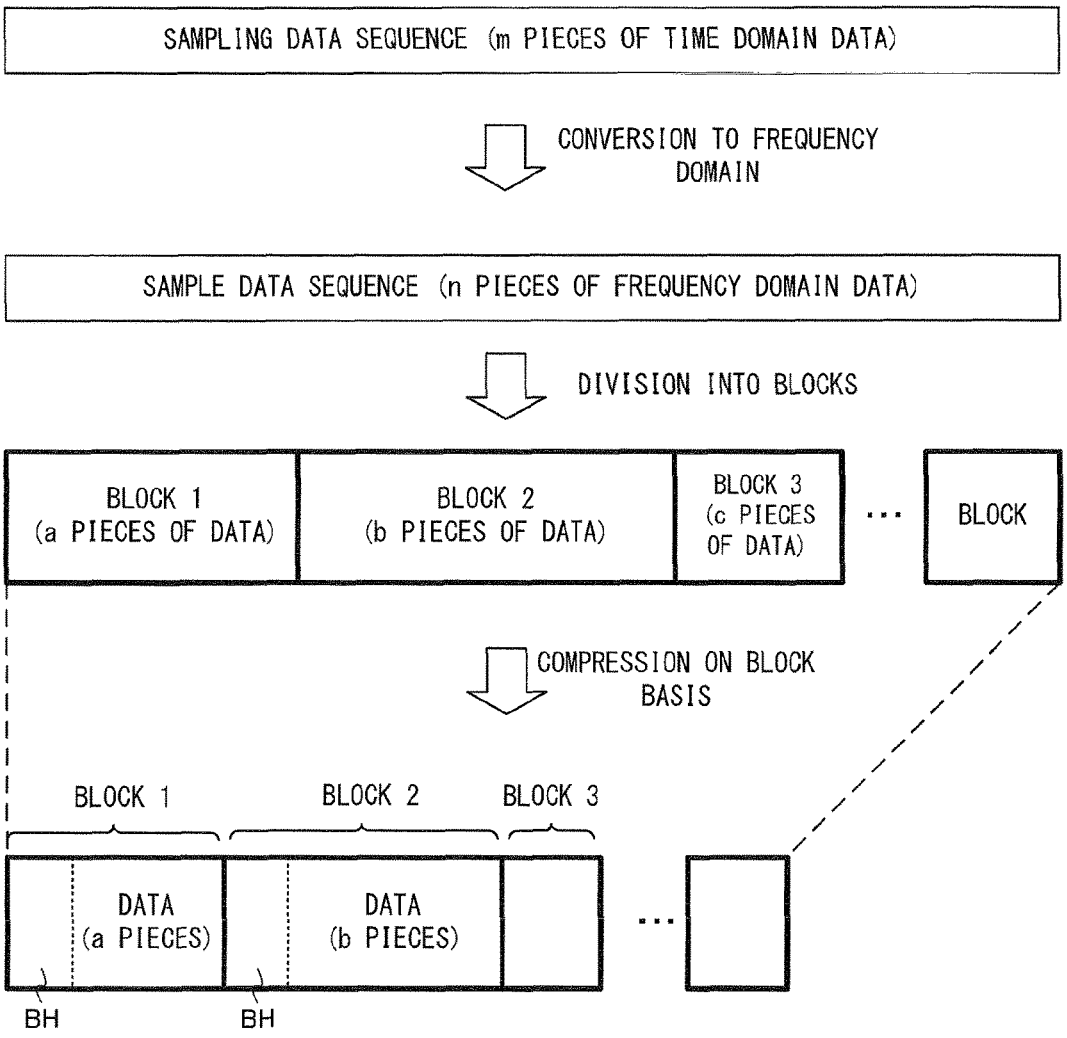
FIG. 2 is a diagram showing a non-limiting example of an overview of an audio compression process according to an exemplary embodiment.

Next, a description is given of an overview of a data compression process performed by the data compression/decompression apparatus 10. FIG. 2 is a diagram showing an overview of an audio compression process according to the exemplary embodiment.

As shown in FIG. 2, first, sampling data is acquired by sampling an analog audio signal with a predetermined sampling period. Here, it is assumed that m pieces of sampling data (m is a positive integer) are acquired during a period of time T. This data sequence of pieces of time domain sampling data is subjected to a predetermined conversion so as to be converted into pieces of frequency domain data (a frequency spectrum). The predetermined conversion may be a modified discrete cosine transform (MDCT) described later, or may be any conversion method such as a discrete cosine transform (DCT), a Fourier transform, or a transform derived therefrom.

The predetermined conversion results in acquiring, for example, n pieces of frequency domain data (n is a positive integer). That is, the time domain data sequence acquired during the period of time T is subjected to a predetermined process so as to be converted into, for example, the coefficients of a linear combination of cosine functions (the sum of cosine functions having various frequencies and amplitudes) as a frequency domain data sequence. The frequency domain data sequence obtained here is a sequence of n numbers arranged in order from the lowest to the highest frequency. It should be noted that, here, the frequency domain data (a coefficient of a cosine function of a particular frequency) obtained as a result of the predetermined conversion is occasionally referred to as "sample data" in order to be distinguished from the sampling data described above.

As shown in FIG. 2, the n pieces of frequency domain data are divided into a plurality of blocks. Specifically, the data sequence of the n pieces of frequency domain data is divided into a plurality of blocks such that the number of pieces of data included in each block is variable. That is, a plurality of pieces of frequency domain data (a plurality of pieces of sample data) are included in each block, and the numbers of pieces of frequency domain data included in the respective blocks are different from one block to another. For example, a block 1 includes a pieces of sample data, and a block 2 includes b pieces of sample data.

Then, compression is performed on a block basis. Here, to each block, a block header BH (decompression information) for decompressing (decoding) the block is added. The block header BH is used to decompress compressed data. It should be noted that the compression does not need to be performed after the division of the n pieces of sample data into the plurality of blocks. Alternatively, the compression and the division into the blocks may be simultaneously performed (the processing order does not matter).

As described above, in the exemplary embodiment, a data sequence converted from the time domain to the frequency domain is divided into blocks of variable lengths, and the blocks are compressed. This makes it possible to increase the compression efficiency.

The method of compressing each block may be any method. As an example, a description is given below of the method of compressing each block according to the exemplary embodiment. For example, in the exemplary embodiment, each block is compressed on the basis of the number of bits required to represent each piece of sample data.

Figure 3:
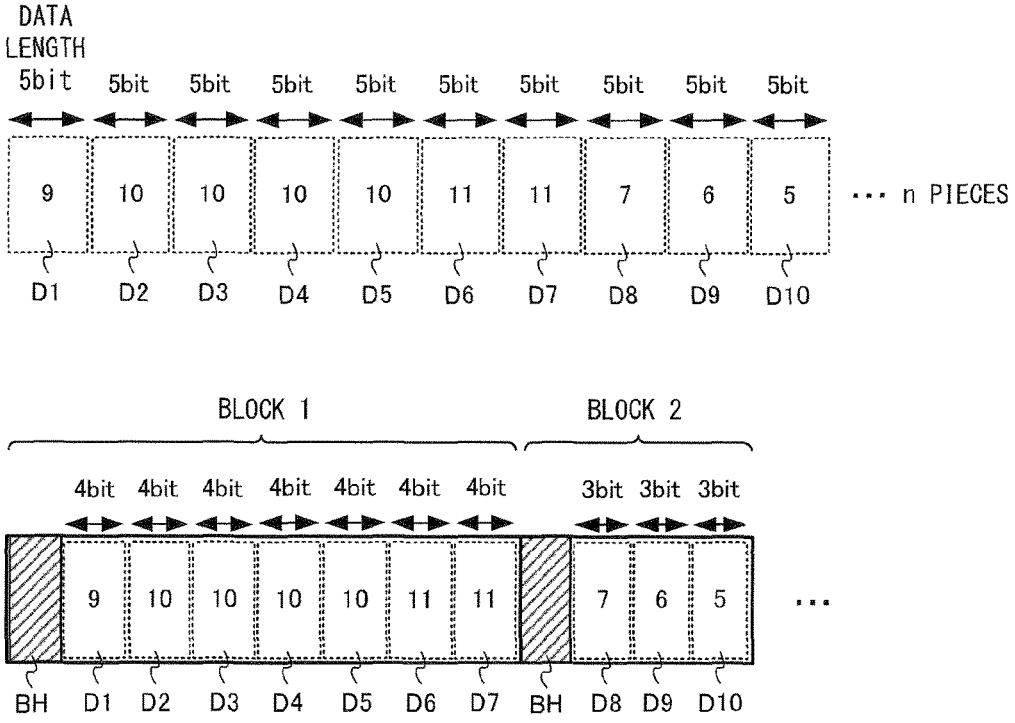
FIG. 3 is a diagram showing a non-limiting example of a method of compressing blocks according to the exemplary embodiment.

FIG. 3 is a diagram showing an example of the method of compressing blocks according to the exemplary embodiment. As shown in FIG. 3, it is assumed that the time domain data is subjected to the predetermined conversion to obtain a frequency domain data sequence including, for example, sample data D1, sample data D2, . . . , and sample data Dn. It is assumed that the size of each piece of sample data is, for example, 5 bits. In this case, the size of the entire sample data sequence is 5n bits.

Here, a value shown in FIG. 3 is stored in each piece of sample data whose bit size is 5 bits. For example, "9" is stored in the data D1; "10" is stored in the data D2; "10" is stored in the data D3; and "10" is stored in the data D4. Although the size of each piece of data is 5 bits (5 bits are secured for each piece of data), the number of bits required to represent the piece of data (the number of bits required to represent the value of the piece of data) is 4 bits. Thus, pieces of data having the same number of bits required to represent the piece of data are assembled in one block. Then, the numbers of bits of the pieces of data included in the block are reduced, thereby compressing the size of the block.

Specifically, as shown in FIG. 3, the data D1 through D7 have values ranging from 9 to 11, and therefore can be represented by 4 bits. Thus, the data D1 through D7 are assembled in a block 1. Further, the data D8 through D10 have values ranging from 5 to 7, and therefore can be represented by 3 bits. Thus, the data D8 through D10 are assembled in a block 2.

Then, the number of bits of each piece of data included in the block 1 is reduced to the required number of bits. For example, each piece of data in the block 1 can be represented by 4 bits. Thus, the size of each piece of data in the block 1 is changed from 5 bits to 4 bits, so that the number of bits of each piece of data is reduced by 1 bit. Further, each piece of data in the block 2 can be represented by 3 bits. Thus, the size of each piece of data in the block 2 is changed from 5 bits to 3 bits, so that the number of bits of each piece of data is reduced by 2 bits.

The block header BH is added to each block. The block header BH includes information required to decompress (decode) the pieces of sample data included in the block. Specifically, the block header BH includes information regarding the bit size of each piece of sample data included in the block (the bit length assigned to each piece of sample data), and the number of the pieces of sample data (the number of the samples) included in the block.

For example, the block header BH of the block 1 stores "4" as the bit size of each piece of sample data, and stores "7" as the number of the samples. The bit size of each piece of sample data included in the block and the number of the pieces of sample data included in the block make it possible to distinguish the separations between the pieces of data, which makes it possible to decompress each piece of compressed data.

It should be noted that, although details of the process will be described later, in the exemplary embodiment, each block is generated by processing the sample data sequence in order, starting from the beginning piece of data. Specifically, if the number of bits for a current block B1 (the number of bits of each piece of data included in the current block B1) and the number of bits of subsequent data Dn+1 are the same as each other, the subsequent data Dn+1 is included in the block B1. Even when the number of bits for the current block B1 and the number of bits of the subsequent data Dn+1 are different from each other, if the current block B1 and the subsequent data Dn+1 satisfy a predetermined condition, the subsequent data Dn+1 is included in the block B1. If the current block B1 and the subsequent data Dn+1 does not satisfy the predetermined condition, the subsequent data Dn+1 is divided from the block B1 and included in a subsequent block B2. After this, the subsequent blocks B2, B3 . . . are generated by performing a similar process.

As described above, pieces of sample data having the same number (or similar numbers) of bits required to represent the piece of data are assembled in one block, and each piece of data is represented by the required number of bits. In other words, from each piece of data included in the block, bits unnecessary for the representation of the piece of data are removed. Data is thus compressed on a block basis, thereby reducing the data size of the entire data.

For example, if time domain data obtained by sampling an audio signal is converted into frequency domain data, it is possible to obtain a sample data sequence in which the pieces of sample data are arranged in order from the lowest to the highest frequency. In this case, the pieces of sample data corresponding to the range of the frequencies inaudible to the human ear may be deleted from the data sequence, thereby obtaining only the pieces of sample data corresponding to the frequencies audible to the human ear. There may be a case where, in the sample data sequence thus obtained, pieces of data having relatively close values are grouped. Such pieces of data having close values can be represented by the same number of bits, and therefore are represented by the same number of bits and assembled in one block. Then, the number of bits is reduced on a block basis, thereby compressing the data.

Here, the data size of the entire data when compressed varies depending on how the plurality of pieces of sample data are assembled in blocks. That is, depending on how many blocks the obtained sample data sequence is divided into and how many pieces of data are assigned to each block, the data size of the entire data when each block is compressed varies.

Figure 4:
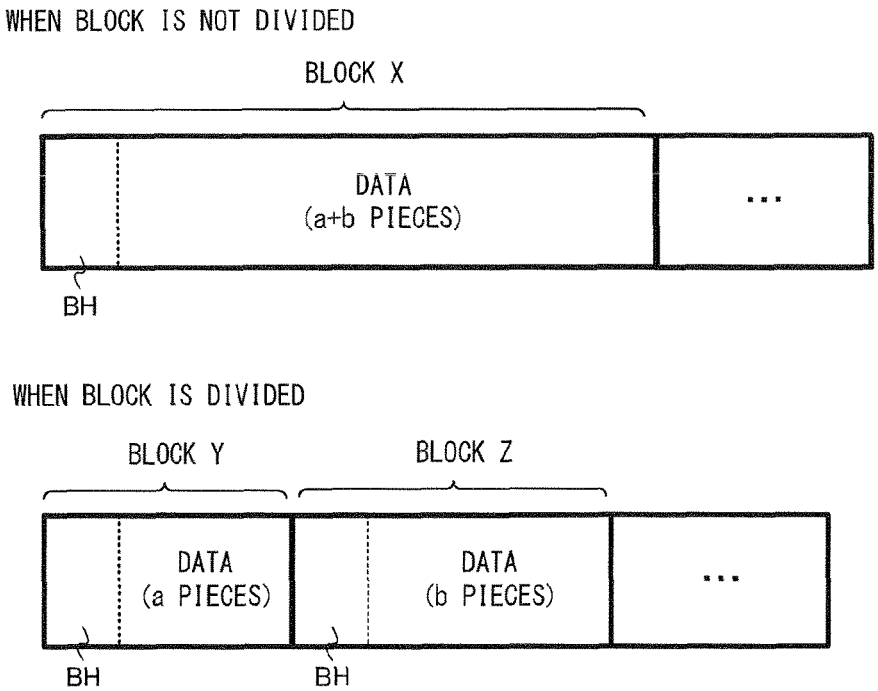
FIG. 4 is a diagram showing a non-limiting example of the data size when a block is not divided and the data size when the block is divided.

FIG. 4 is a diagram showing the data size when a block is not divided and the data size when the block is divided. As shown in FIG. 4, the data size of the entire data including block headers BH is different between when a+b pieces of sample data are stored in a block X and when a pieces of sample data are stored in a block Y and b pieces of sample data are stored in a block Z. That is, if one block is divided into two blocks, a block header BH is newly added, which increases the data size. At the same time, if one block is divided into two blocks, the size of the entire data may be reduced.

In the exemplary embodiment, taking into account the data size when one block is divided into two blocks and the data size when the one block is not divided, it is determined whether or not the one block is to be divided. Then, if the division of the one block results in a smaller data size, the one block is divided into two blocks.

For example, if the data sequence is divided into blocks on the basis of the number of bits of each piece of data as described above, the data size of the block X including the a+b pieces of sample data as shown in FIG. 4 is BH+(the number of bits of each piece of sample data)×(a+b). On the other hand, if the block X is divided into the block Y (the number of pieces of data is a) and the block Z (the number of pieces of data is b), the data size of the block Y is BH+(the number of bits of each piece of sample data in the block Y)×a. Further, in this case, the data size of the block Z is BH+(the number of bits of each piece of sample data in the block Z)×b. If the total size of the block Y and the block Z is smaller than the size of the block X, the division of the block X into the block Y and the block Z results in a smaller data size of the entire data.

As described above, in the exemplary embodiment, taking into account the data size when a block is divided and the data size when the block is not divided, it is determined, on the basis of the condition for the division of the block, whether or not the block is to be divided. Then, the block is divided in accordance with the determination result. That is, if the size of the data compressed when the block is not divided is larger than the size of the data compressed when the block is divided, the block is divided. In the exemplary embodiment, each block is generated on the basis of the number of bits required to represent each piece of data. In this case, the condition for the division of the block is a formula (4) or a formula (8) described later. Details of the condition for the division will be described later.

It should be noted that, in the above embodiment, it is determined whether or not a block is to be divided, and if it is determined that the block is to be divided, the block is divided. That is, in the above embodiment, a data sequence is divided into a plurality of blocks such that the separation positions of the blocks are variable, whereby the number of blocks into which the data sequence is divided and the number of pieces of data included in each block are variable. Alternatively, in another embodiment, while the number of blocks may be fixed, it may be determined where the separation positions of the blocks are to be set. That is, the number of blocks may be fixed, and the number of pieces of data included in each block may be variable. Even if the number of blocks is the same, the size of the entire data when compressed may vary depending on the number of pieces of data included in each block.

Figure 5:
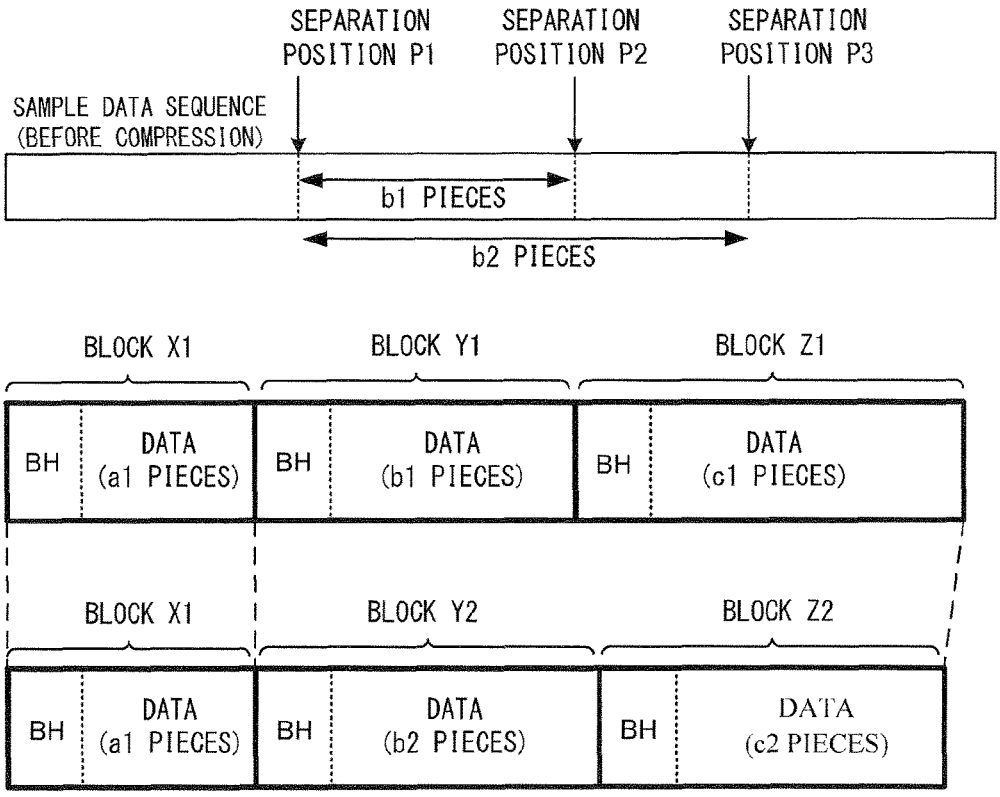
FIG. 5 is a diagram showing a non-limiting example of, when a sample data sequence is divided into three blocks, the data sizes of the compressed data based on the differences in separation positions.

FIG. 5 is a diagram showing, when the sample data sequence is divided into three blocks, the data sizes of the compressed data based on the differences in the separation positions. For example, it is assumed that, if the sample data sequence obtained by a predetermined conversion is separated at a separation position P1, the number of pieces of data counted from the beginning piece of data to the separation position P1 is a1. In this case, if the pieces of data from the beginning piece of data to the a1th piece of data are assembled in one block and compressed, a block X1 is formed.

Next, if b1 pieces of data from the separation position P1 to a separation position P2 are assembled in one block and compressed, a block Y1 is formed. Then, if c1 pieces of data from the separation position P2 to the end of the data sequence are assembled in one block and compressed, a block Z1 is formed.

On the other hand, if b2 pieces of data from the separation position P1 to a separation position P3 are assembled in one block and compressed, a block Y2 is formed. Then, if c2 pieces of data from the separation position P3 to the end of the data sequence are assembled in one block and compressed, a block Z2 is formed.

At this time, if the sum of the sizes of the block X1, the block Y2, and the block Z2 is smaller than the sum of the sizes of the block X1, the block Y1, and the block Z1, the separation position P3 of the pieces of data results in a higher compression ratio than the separation position P2. As described above, while the number of blocks may be fixed, the separation positions of the pieces of data may be variable. Thus, the separation positions may be set so as to result in a smaller data size of the data when compressed, which may make it possible to reduce the data size of the entire data.

In addition, although described in detail later, in the above embodiment, blocks are generated on the basis of the numbers of bits of each piece of sample data, and bits unnecessary for the representation of the piece of data in the block is removed, thereby compressing each block. Alternatively, in another embodiment, blocks may be generated not on the basis of the number of bits, or each block may be compressed by another compression method.

For example, another compression method may be Huffman coding. For example, to compress audio data (compression target data), the data sequence may be divided into fixed blocks and subjected to Huffman coding. For example, the data sequence may be divided into a plurality of blocks so as to be separated equally, or may be divided into a plurality of blocks so as to be separated unequally. Even if the data sequence is separated unequally, the separation positions are determined in advance. Then, a frequency analysis is performed on the divided blocks (pieces of sample data having the same or close values are defined as one event to obtain the frequency of appearance of each event), and a piece of data having a higher frequency of appearance of the event is assigned a code having a short bit length. Thus, each block is compressed.

Meanwhile, in the exemplary embodiment, a data sequence of pieces of compression target data is divided into a plurality of blocks such that the separation positions of the pieces of data are variable. Specifically, in the exemplary embodiment, the number of pieces of frequency domain data included in each block and the number of blocks are variable. That is, one block may be divided at a particular position so as to be defined as two blocks, or two blocks may be defined as one block, or the separation positions of blocks may be changed. A plurality of blocks thus divided may be compressed using, for example, Huffman coding. If a data sequence is divided and subjected to Huffman coding, the data size of the entire data may be different between when the data sequence is divided into fixed blocks and when the data sequence is divided into variable blocks. For example, if the original data sequence includes a section having a higher frequency of appearance of an event and a section having a lower frequency of appearance of the event, the size of the data when compressed may vary depending on how the original data sequence is divided. In the exemplary embodiment, pieces of data may be divided such that the separation positions of the pieces of data are variable, whereby it may be possible to compress the pieces of data by generating blocks more suitable for the compression.

As described above, in the exemplary embodiment, a data sequence is divided into a plurality of blocks in a more preferable manner, and the blocks are compressed by a predetermined compression method. This makes it possible to, for example, improve the compression ratio.

In addition, in the exemplary embodiment, the description is given of the example where a plurality of blocks are generated on the basis of the number of bits to represent each piece of frequency domain data. Alternatively, in another embodiment, blocks may be generated on the basis not only of the number of bits but also of the categories of the pieces of data. Specifically, the pieces of data may be categorized in accordance with their values, and blocks may be generated such that pieces of data of the same category are assembled in one block.

In addition, in another embodiment, a plurality of blocks may be generated on the basis not only of the number of bits but also of the frequency domain data sequence such that the number of pieces of data included in each block is variable, and a plurality of pieces of frequency domain data are included in each block.

Here, the generation of a plurality of blocks on the basis of the frequency domain data sequence means that the data sequence is divided into a plurality of blocks on the basis of the properties (characteristics) of the data sequence. For example, the data sequence may be divided into a plurality of blocks on the basis of the value of each piece of data included in the data sequence, the number of bits to represent each piece of data, or the like. Alternatively, the data sequence may be divided into blocks on the basis of the similarity between the pieces of data or the continuity between the pieces of data.

The similarity between the pieces of data indicates that the properties of the pieces of data are similar, such as the case where the values of the pieces of data are equal, the case where the values of the pieces of data are similar (the difference between the values is a predetermined value or less), the case where the numbers of bits required to represent the pieces of data are equal, or the case where the numbers of bits are similar (the difference between the numbers of bits is a predetermined value or less). For example, when two pieces of data are subjected to a predetermined conversion, if the values of the pieces of converted data are similar, it can be said that the pieces of data have a similarity. Blocks may be generated such that pieces of data having such a similarity are assembled in one block. For example, if, in a data sequence, pieces of data having a similarity are concentrated in a predetermined range so as to be adjacent to each other, the pieces of data having such a similarity are assembled in one block, and each block is compressed. In this case, information required to decompress each piece of data included in the block is generated on the basis of the similarity.

In addition, the continuity between the pieces of data indicates the property that the values of two pieces of data are continuous, and indicates that the values of a piece of data and a piece of data adjacent thereto or at a position in a predetermined range therefrom are continuous. The values of pieces of data being continuous indicates that the difference between the values of the pieces of data is a predetermined value or less. Further, for example, when a plurality of pieces of data are arranged, if the rate of change in their values is a predetermined value or less, the pieces of data have a continuity. Pieces of data having such a continuity may be assembled in one block, and each block is compressed. In this case, information required to decompress each piece of data included in the block is generated on the basis of the continuity.

Depending on such various properties of the data sequence, the number of blocks into which the data sequence is to be divided may be varied, or the number of pieces of data to be included in each block may be varied.

In addition, in the above embodiment, the frequency domain data sequence is divided into a plurality of blocks such that the separation positions of the pieces of data are optionally determined. Alternatively, in another embodiment, a plurality of patterns defining the separation positions of the pieces of data may be prepared in advance, so that one of the plurality of patterns prepared in advance may be selected on the basis of the characteristics of the data sequence. Then, the frequency domain data sequence may be divided into a plurality of blocks on the basis of the selected pattern of the separation positions.

In addition, in the above embodiment, in terms of improvement of the compression ratio, a data sequence is divided into a plurality of variable blocks, and each block is compressed. Specifically, if the size of the data compressed when a block is divided is smaller than the size of the data compressed when the block is not divided, the block is divided. Alternatively, in another embodiment, in terms not only of improvement of the compression ratio, but also of, for example, improvement of the processing speed, a data sequence may be divided into a plurality of variable blocks, and the blocks may be compressed by a predetermined compression method. That is, the above technique may be used in order to reduce the processing load for compressing or decompressing the data sequence.

In addition, in the above embodiment, a data sequence in which a plurality of pieces of frequency domain data are arranged in order from the lowest to the highest frequency is divided into a plurality of blocks such that the separation positions of the blocks are variable. Alternatively, in another embodiment, a data sequence in which a plurality of pieces of frequency domain data are arranged in order from the highest to the lowest frequency may be divided, and blocks may be generated. Yet alternatively, a plurality of pieces of frequency domain data may be arranged not only in order of frequency but also in a predetermined order, and blocks may be generated. Yet alternatively, for example, a plurality of pieces of data may be arranged on a two-dimensional plane, and a plurality of blocks may be generated such that the separation positions of the blocks are variable.

In addition, in the above embodiment, it is assumed that a sound is compressed. Alternatively, in another embodiment, not only a sound but also, for example, an image may be compressed. For example, a particular image may be divided into rectangular areas of predetermined sizes and subjected to a transform such as an MDCT to generate pieces of frequency domain data. A data sequence in which the pieces of generated frequency domain data are arranged may be divided into a plurality of blocks such that the separation positions of the blocks are variable (the number of pieces of data included in each block is variable). Then, the data may be compressed on a divided block basis.

(Details of Processing)

Next, a description is given of details of the processing performed by the data compression/decompression apparatus 10. Descriptions are given below of an encoding process performed by the encoding section 13 and a decoding process performed by the decoding section 15. First, with reference to FIGS. 6 through 9, a description is given of the encoding process performed by the encoding section 13.

It should be noted that the encoding process and the decoding process shown below are performed as a result of the CPU included in the data compression/decompression apparatus 10 executing an audio compression/decompression program loaded into a memory. That is, the encoding section 13 and the decoding section 15 are achieved as a result of the CPU executing the audio compression/decompression program. The audio compression/decompression program may be, for example, stored in advance in a storage medium (for example, a non-volatile memory, a magnetic disk, or an optical disk), or may be supplied from another apparatus via wireless or wired communication. The storage medium may be detachably connected to the data compression/decompression apparatus 10, or may be built into the data compression/decompression apparatus 10.

Figure 6:
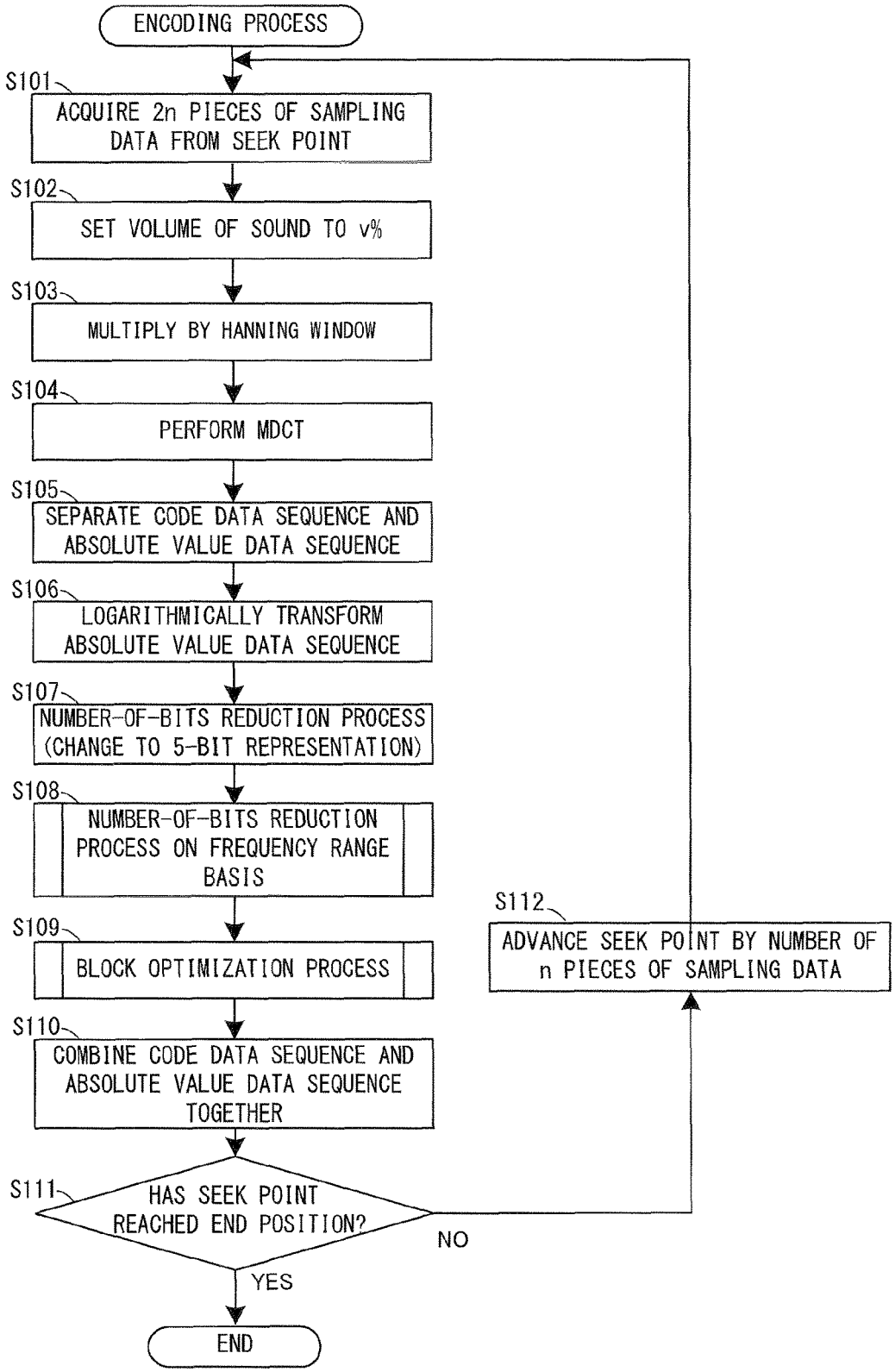
FIG. 6 is a main flow chart showing a non-limiting example of the flow of an encoding process performed by an encoding section 13.

FIG. 6 is a main flow chart showing the flow of the encoding process performed by the encoding section 13.

First, in step S101, the encoding section 13 acquires data of 2n samples from a seek point. Specifically, the encoding section 13 acquires 2n pieces of sampling data sampled during a certain period of time T determined on the basis of the seek point. The pieces of sampling data are those sampled by the A/D conversion section 12.

Figure 10:
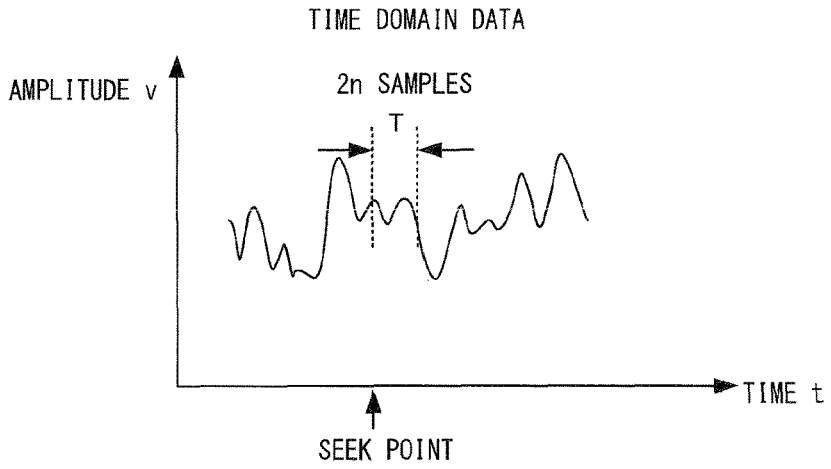
FIG. 10 is a diagram showing a non-limiting example of the waveform of an audio signal input to an input section 11.
Figure 11:
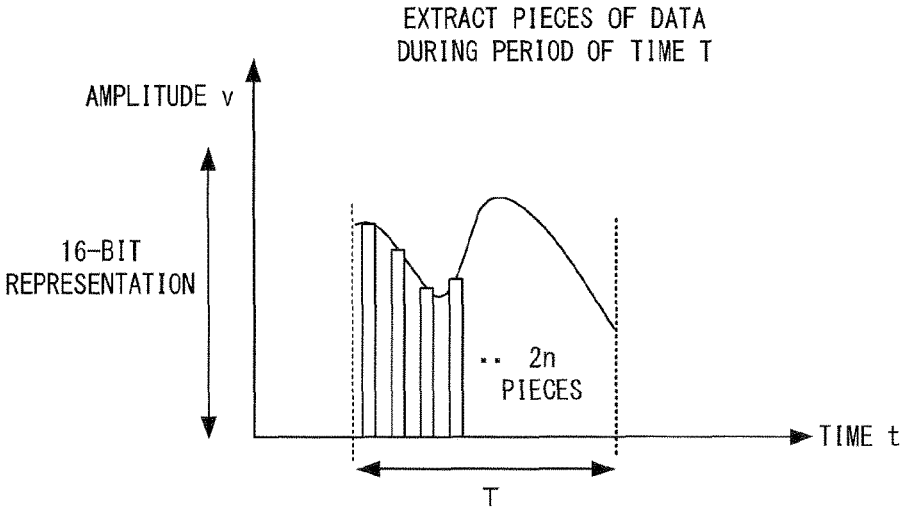
FIG. 11 is a diagram showing a non-limiting example of the waveform of the audio signal during a period of time T.

FIG. 10 is a diagram showing the waveform of an audio signal input to the input section 11. FIG. 11 is a diagram showing the waveform of the audio signal during the period of time T. In FIGS. 10 and 11, the horizontal axis represents time, and the vertical axis represents the amplitude of the audio signal. As shown in FIGS. 10 and 11, in step S101, the encoding section 13 acquires 2n pieces of sampling data sampled during the period of time T determined on the basis of the seek point. The A/D conversion section 12 samples an audio signal with a predetermined sampling period (for example, 44 kHz), and temporarily stores the pieces of sampling data in a storage section (not shown) such as a memory. Each piece of sampling data is data representing the amplitude at a particular time, and is time domain data. As shown in FIG. 11, the pieces of sampling data stored here are pieces of data whose values represent real numerical values represented by, for example, 16 bits.

After acquiring the 2n pieces of sampling data, the encoding section 13 next performs the process of step S102.

Figure 12:
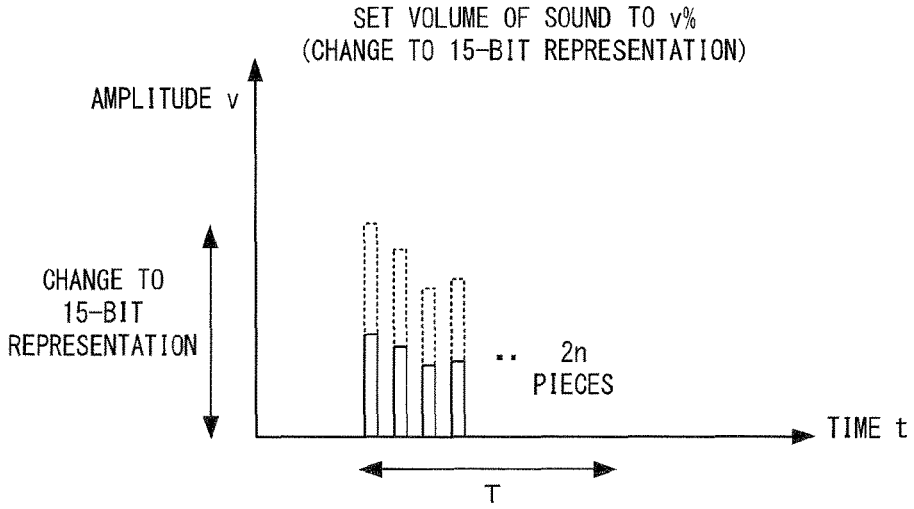
FIG. 12 is a diagram showing a non-limiting example of the state where pieces of acquired time domain data are compressed.

In step S102, the encoding section 13 sets the volume of the sound to v %. Here, the encoding section 13 compresses the range of the value of each piece of acquired time domain data. FIG. 12 is a diagram showing the state where the pieces of acquired time domain data are compressed.

Specifically, as shown in FIG. 12, the encoding section 13 sets each piece of sampling data to v % (for example, 40%). This results in representing, by 15 bits, the pieces of sampling data represented by 16 bits. That is, the encoding section 13 compresses the region, in the memory, to be assigned to each piece of sampling data to 15 bits.

After step S102, the encoding section 13 multiplies the 2n pieces of acquired data by, for example, a Hanning window (a window function) (step S103). The encoding section 13 next performs the process of step S104.

Figures 13, 14:
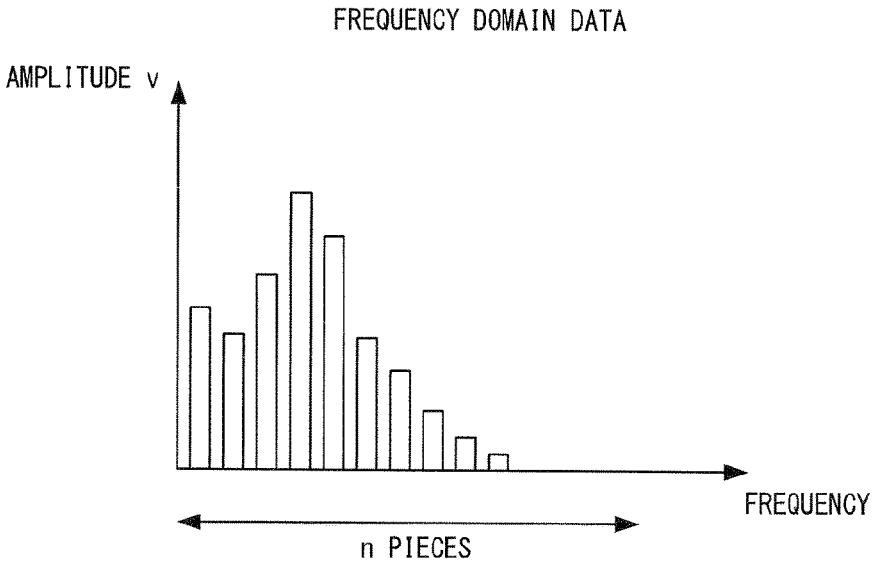
FIG. 13 is a diagram showing a non-limiting example of pieces of frequency domain data obtained by performing an MDCT.
FIG. 14 is a diagram illustrating a non-limiting example of the separation into a sign data sequence and an absolute value data sequence.

In step S104, the encoding section 13 performs an MDCT (modified discrete cosine transform). By performing an MDCT, n pieces of frequency domain data are obtained from the 2n pieces of sampling data. The following processes are performed on the n pieces of data. FIG. 13 is a diagram showing an example of the pieces of frequency domain data obtained by performing an MDCT. In FIG. 13, the horizontal axis represents frequency. As shown in FIG. 13, by performing an MDCT, n pieces of frequency domain data (sample data) are obtained from the 2n pieces of time domain data. The data sequence of the n pieces of data obtained as a result of the process of step S104 is a sequence of real numbers arranged in order from the lowest to the highest frequency.

Next, in step S105, the encoding section 13 separates the data sequence of the n pieces of sample data obtained by performing an MDCT, into a data sequence of pieces of sign data and a data sequence of pieces of absolute value data. FIG. 14 is a diagram illustrating the separation into the sign data sequence and the absolute value data sequence. As shown in FIG. 14, the pieces of sample data obtained by performing an MDCT include negative numerical values. Here, to facilitate the following calculations, the sample data sequence obtained by performing an MDCT is separated into the absolute value data sequence and the sign data sequence. In the following steps S106 through S109, the processes are performed on a data sequence of n pieces of absolute value data separated in step S105.

Next, in step S106, the encoding section 13 logarithmically transforms each piece of data of the absolute value data sequence obtained in step S105. The data sequence obtained by the logarithmic transform is temporarily stored in a memory. The encoding section 13 next performs the process of step S107.

In step S107, the encoding section 13 performs a number-of-bits reduction process (a change to a 5-bit representation). Here, the encoding section 13 represents, by 5 bits, each piece of data obtained in the process of step S106 and represented by, for example, 16 bits.

Figure 15:
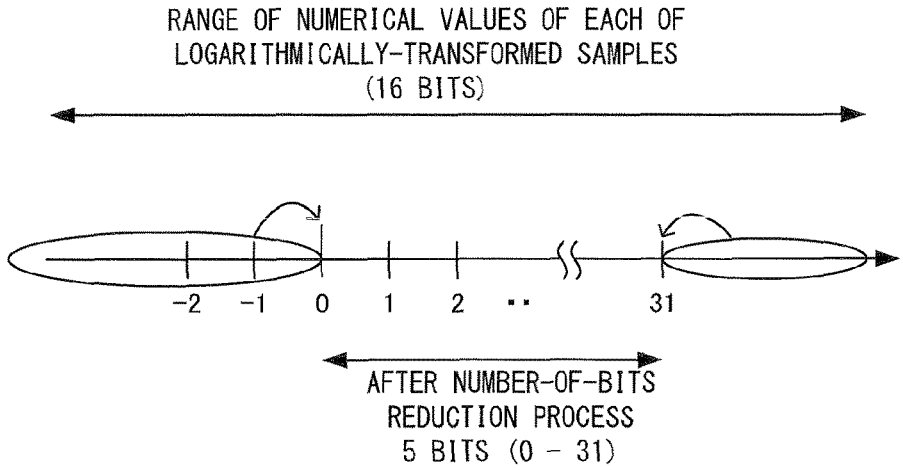
FIG. 15 is a diagram illustrating a non-limiting example of a number-of-bits reduction process (a change to a 5-bit representation) in step S107.

FIG. 15 is a diagram illustrating the number-of-bits reduction process (the change to a 5-bit representation) in step S107. As shown in FIG. 15, each piece of logarithmically-transformed data is a piece of data represented by, for example, 16 bits. Here, in the number-of-bits reduction process (the change to a 5-bit representation), it is defined that, in each piece of data logarithmically-transformed in step S106, values less than 0 are 0, and values greater than 31 are 31. Thus, each piece of data is represented by 5 bits and also represented by integer values ranging from 0 to 31. In each piece of data logarithmically-transformed in step S106, a value included in the range of 0 to 31 is maintained as it is (the numbers after the decimal point are disregarded, for example).

For example, if the value of one of the pieces of logarithmically-transformed data is negative, the absolute value of the piece of data is relatively small (the amplitude of a particular frequency component is small). Thus, even if such a piece of data is neglected (the value is changed to "0"), the reception of the sound obtained by decompressing the pieces of data is not significantly affected. Further, if the value of one of the pieces of logarithmically-transformed data is 32 or greater, the amplitude is so large that it is difficult for a human being to even recognize the difference between 31 and 32 or greater. Thus, even if a piece of data having a value of "32" or greater, whose difference is difficult for a human being to recognize, is set to "31", the reception of the sound is not significantly affected. Thus, in step S107, each piece of data is represented by a value included in the range of 0 to 31, so as to be represented by 5 bits. That is, each piece of frequency domain data is assigned 5 bits again. The number of bits of each piece of data is thus reduced.

Next, in step S108, the encoding section 13 performs a number-of-bits reduction process on a frequency range basis. Here, the encoding section 13 further reduces, on a frequency range basis, the number of bits of each piece of data of the data sequence obtained in the process of step S107. Details of the number-of-bits reduction process on a frequency range basis will be described later with reference to FIG. 7.

After the process of step S108, the encoding section 13 performs a block optimization process (step S109). Here, the encoding section 13 optimizes the data sequence obtained in step S108 to divide the data sequence into a plurality of blocks, and also compresses each block. Details of the block optimization process will be described later with reference to FIG. 8.

Next, in step S110, the encoding section 13 combines together the sign data sequence separated in step S105 and the absolute value data sequence obtained in step S109.

Next, in step S111, the encoding section 13 determines whether or not the seek point has reached an end position. If the determination result is positive, the encoding section 13 ends the encoding process shown in FIG. 6. On the other hand, if the determination result is negative, the encoding section 13 advances the seek point by the number of n pieces of sampling data (step S112), and performs the process of step S101 again.

The processes of steps S101 through S111 are thus repeated, whereby audio data is compressed and stored in the compressed data storage section 14.

Next, descriptions are given of the number-of-bits reduction process on a frequency range basis in step S108 described above and the block optimization process in step S109 described above. Before details of these processes are described, the definitions of a block and a frame according to the exemplary embodiment are described.

(Formats of Frame and Block)

Figure 16:
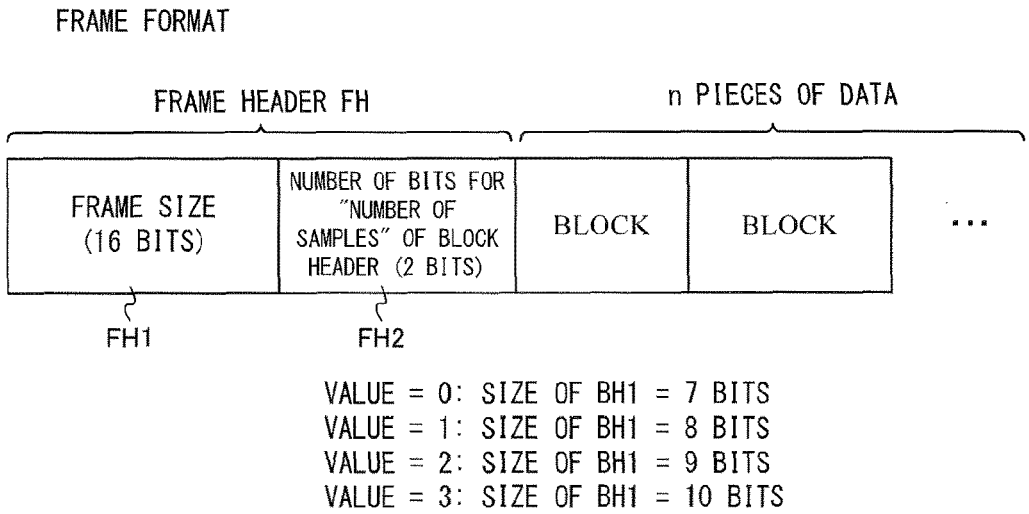
FIG. 16 is a diagram showing a non-limiting example of the definition of a frame according to the exemplary embodiment.
Figure 17:
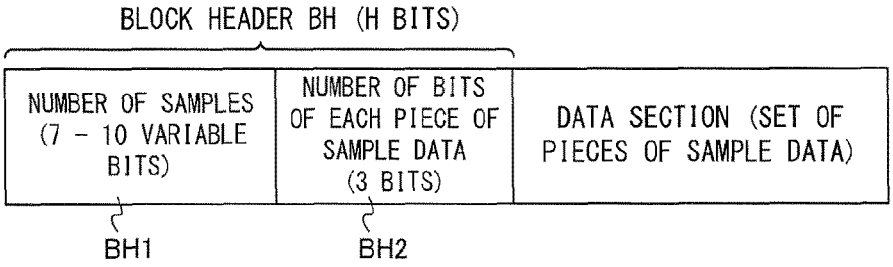
FIG. 17 is a diagram showing a non-limiting example of the definition of a block according to the exemplary embodiment.

FIG. 16 is a diagram showing the definition of a frame according to the exemplary embodiment. FIG. 17 is a diagram showing the definition of a block according to the exemplary embodiment.

In the exemplary embodiment, the encoding process shown in FIG. 6 is performed on a frame basis as shown in FIG. 16. As shown in FIG. 16, a frame includes a frame header FH and a plurality of blocks. The frame header FH includes a region FH1 for storing a frame size, and a region FH2 for specifying the number of bits for "the number of samples" in block headers BH. The "frame size" represents the size of the entire frame. The region FH1 representing the frame size is assigned 16 bits. 'The number of bits for "the number of samples" in block headers BH' is the number of bits assigned to regions BH1 representing "the number of samples" in the respective block headers BH (see FIG. 17). The region FH2 is assigned 2 bits.

For example, if the region FH2 stores a value of 0, the regions BH1 of the respective block headers BH are assigned 7 bits. Further, if the region FH2 stores a value of 1, the regions BH1 of the respective block headers BH are assigned 8 bits. If the region FH2 stores a value of 2, the regions BH1 of the respective block headers BH are assigned 9 bits. If the region FH2 stores a value of 3, the regions BH1 of the respective block headers BH are assigned 10 bits.

As shown in FIG. 16, the frame includes a plurality of blocks. As shown in FIG. 17, each block is divided into a block header BH and a data section. The block header BH is information required to decompress each piece of sample data included in the data section. Specifically, the block header BH is further divided into a region BH1 for storing "the number of samples", and a region BH2 representing "the number of bits of each piece of sample data". It should be noted that the block header BH does not need to be added to the data section, and the data section and the block header BH of the block may be separated from each other.

The size of the region BH1 is variable, and is, as described above, determined by the value stored in the region FH2 of the frame header FH. For example, if the region FH2 of the frame header FH stores "0", the size of the region BH1 of the block header BH is 7 bits. The value stored in the region BH1 represents the number of pieces of sample data (the number of samples) included in the data section of the block. For example, if the size of the region BH1 is 7 bits, the data section of the block can include up to 127 pieces of sample data. For example, if the size of the region BH1 is 7 bits and the block includes four pieces of data, the value stored in the region BH1 is "0000100" (the binary representation). Hereinafter, the size of the block header BH of the block shown in FIG. 17 is occasionally represented by H [bits].

As described above, in the exemplary embodiment, the frame includes the frame header FH and a plurality of blocks. The frame header FH includes information representing the sizes of the block headers BH. That is, the sizes of all the block headers BH (the sizes of all the regions BH1) included in the frame are specified by specifying the value of the frame header FH. This makes it possible to specify the header size of each block.

In addition, "the number of bits of each piece of sample data" of the block header BH is the number of bits assigned to each piece of sample data included in the data section. The region BH2 representing "the number of bits of each piece of sample data" is assigned, for example, 3 bits (a fixed length). For example, if "the number of bits of each piece of sample data" is set to "101" (the binary representation; "5"

in the decimal representation), it means that the size of each piece of sample data included in the data section is "5" bits.

As described above, the block header BH is variable, and the upper limit of the number of pieces of data included in the block is determined by the size of the region BH1 of the block header BH. For example, if the region BH1 is assigned 8 bits, the block can include up to 256 pieces of data. If the region BH1 is assigned 9 bits, the block can include up to 512 pieces of data.

In the exemplary embodiment, the value set in the region FH2 varies depending on the frame. For example, in a frame, the region FH2 of the frame header FH stores the value "0", and stores compressed data (the maximum number of pieces of data in each block of the frame is 128 (7 bits) at this time). Meanwhile, in another frame, the region FH2 of the frame header FH stores the value "1", and stores compressed data (the maximum number of pieces of data in each block of the frame is 256 (8 bits) at this time).

It should be noted that, if "the number of bits of each piece of sample data" of the block header BH stores the value "0", it means that the data section of the block has no data. Further, if "the number of samples" of the block header BH stores the value "0", it means that the same value continues to the last piece of sample data in the frame. That is, if pieces of sample data having a value of 0 continue to the end of the frame, the values and the number of the pieces of sample data are omitted.

(Details of Number-of-Bits Reduction Process on Frequency Range Basis)

Figure 7:
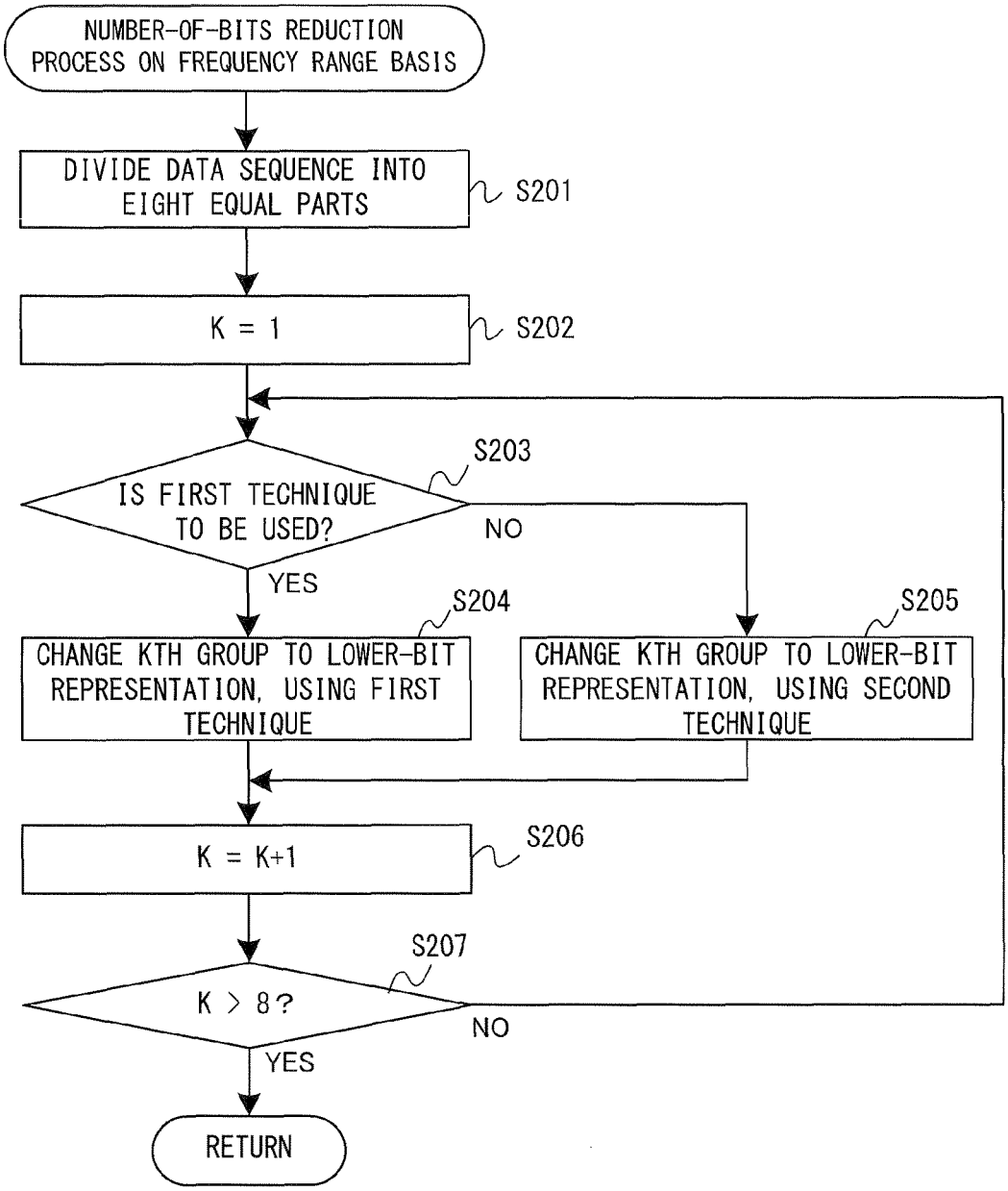
FIG. 7 is a flow chart showing a non-limiting example of details of a number-of-bits reduction process on a frequency range basis in step S108.

Next, details of the number-of-bits reduction process on a frequency range basis in step S108 are described. FIG. 7 is a flow chart showing details of the number-of-bits reduction process on a frequency range basis in step S108.

As shown in FIG. 7, in step S201, the encoding section 13 divides the data sequence into eight equal parts. Specifically, the encoding section 13 divides the data sequence, changed to a 5-bit representation in the process of step S107, into eight groups on a frequency range basis such that each group includes the same number of pieces of data. Here, unlike the block described above, each group includes the same number of pieces of sample data. Thus, a set of pieces of data divided in step S201 is represented as a "group" in order to be distinguished from the "block" described above.

Next, in step S202, the encoding section 13 sets a counter K to 1. Subsequently, in step S203, the encoding section 13 determines whether or not a first technique is to be used. In step S203, the encoding section 13 determines whether or not the first technique is to be used as a technique of changing pieces of data of a Kth group to a lower-bit representation (a technique of reducing the number of bits). Specifically, on the basis of the value of K, the encoding section 13 determines whether or not the first technique is to be used. It should be noted that the "first technique" will be described in detail later.

If the determination result of step S203 is positive, in step S204, the encoding section 13 changes the Kth group to a lower-bit representation, using the first technique. On the other hand, if the determination result of step S203 is negative, in step S205, the encoding section 13 changes the Kth group to a lower-bit representation, using a second technique. It should be noted that the "second technique" will be described in detail later. The process of step S204 or S205 is the process of reducing the number of bits of each piece of data included in the Kth group of the eight equal groups.

After the process of step S204 or S205, in step S206, the encoding section 13 adds 1 to K. Then, in the subsequent step S207, the encoding section 13 determines whether or not K is greater than 8. If the determination result is positive, the encoding section 13 ends the number-of-bits reduction process on a frequency range basis shown in FIG. 7. On the other hand, if the determination result is negative, the encoding section 13 performs the process of step S203 again. The processes of steps S203 through S207 are repeatedly performed, whereby each of the eight equal groups is changed to a lower-bit representation, using the first technique or the second technique. This is the end of the description of the flow chart of FIG. 7.

Figure 18:
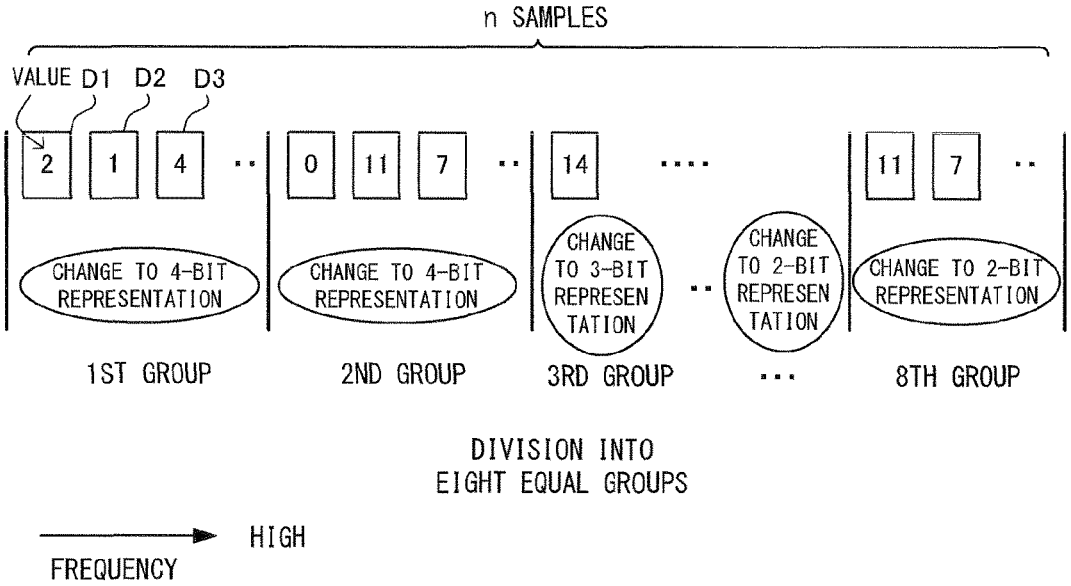
FIG. 18 is a diagram showing a non-limiting example of an overview of the number-of-bits reduction process on a frequency range basis.

Next, with reference to FIG. 18, a description is given of an overview of the number-of-bits reduction process on a frequency range basis shown in the flow chart of FIG. 7.

FIG. 18 is a diagram showing an overview of the number-of-bits reduction process on a frequency range basis. As shown in FIG. 18, the data sequence to be processed here is a frequency domain data sequence in which the pieces of frequency domain data are arranged in order of frequency, from the lowest to the highest frequency component. In step S201, the data sequence of the n pieces of data (data D1, data D2, . . . , and data DN) is divided into eight equal groups. Then, the process is performed of reducing the number of bits for each group, using the first technique or the second technique (step S204 or S205). As a result of the number-of-bits reduction process, each piece of data of, for example, the first group and the second group, which has been represented by 5 bits, is represented by 4 bits. Further, each piece of data of the third group, which has been represented by 5 bits, is represented by 3 bits. Each piece of data of the eighth group is represented by 2 bits.

For example, if n=512, each group includes 64 pieces of sample data. In this case, the first to 128th pieces of sample data included in the first and second groups have relatively low frequency components, and therefore, the number of bits of each of the first to 128th pieces of sample data is reduced by 1 bit. On the other hand, the 449th to 512th pieces of sample data included in the eighth group have relatively high frequency components, and therefore, the number of bits of each of the 449th to 512th pieces of sample data is reduced by 3 bits.

Figure 19:
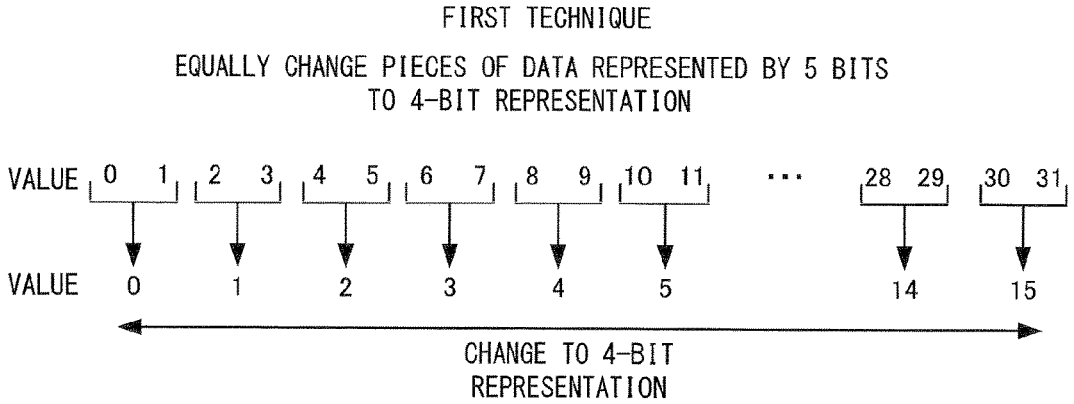
FIG. 19 is a diagram showing a non-limiting example of a change to a lower-bit representation using a first technique, and is a diagram showing a non-limiting example of the process of reducing the number of bits from 5 bits to 4 bits, using the first technique.

FIG. 19 is a diagram showing a change to a lower-bit representation using the first technique, and is a diagram showing the process of reducing the number of bits from 5 bits to 4 bits, using the first technique.

As shown in FIG. 19, in the first technique, decimal values of 0 and 1 are redefined as "0", decimal values of 2 and 3 are redefined as "1", and decimal values of 4 and 5 are redefined as "2", each decimal value represented by 5 bits. That is, in the first technique, the quotient of dividing, by 2, a decimal value represented by 5 bits is defined as a value after a change to a lower-bit representation. Consequently, the numbers ranging from 0 to 31 (5 bits) become the numbers ranging from 0 to 15 (4 bits). Then, the region assigned to each piece of data is changed from 5 bits to 4 bits. As described above, the first technique equally compresses the entire range of values.

Figure 20:
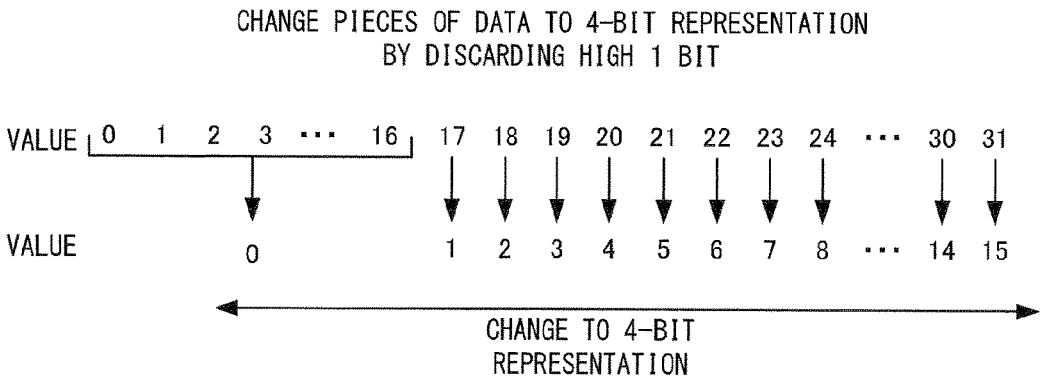
FIG. 20 is a diagram showing a non-limiting example of a change to a lower-bit representation using a second technique, and is a diagram showing a non-limiting example of the process of reducing the number of bits from 5 bits to 4 bits, using the second technique.

FIG. 20 is a diagram showing a change to a lower-bit representation using the second technique, and is a diagram showing the process of reducing the number of bits from 5 bits to 4 bits, using the second technique.

As shown in FIG. 20, in the second technique, decimal values of 0 to 16 are redefined as "0", and decimal values of 17 to 31 are redefined as "1 to 15", respectively, each decimal value represented by 5 bits. That is, in the second technique, relatively small values, namely 0 to 16, are discarded as "0", and relatively large values, namely 17 to 31, are left. Consequently, the numbers ranging from 0 to 31 (5 bits) become the numbers ranging from 0 to 15 (4 bits). As described above, the second technique discards smaller values, namely 0 to 16, and leaves only larger values. A small value of each piece of data means that the amplitude of the frequency component (which is related to the volume of the sound) is small. A small sound is difficult for a human being to hear. Thus, even if such a sound is changed to "0", it may not affect the reception of the sound. Thus, the second technique discards smaller values, and leaves only larger values.

It should be noted that the cutting off of even a small sound may result in the deterioration of the sound quality, depending on the frequency or the type of the sound. Thus, the first technique is used rather than the second technique, depending on the frequency or the type of the sound. For example, in a relatively high frequency component, even the cutting off of a small sound may make it unlikely that the sound quality deteriorates. Further, the use of the second technique instead of the first technique, which equally makes a change to a lower-bit representation, may make it less likely that the sound quality deteriorates, depending on the frequency or the type of the sound. If the first technique is used to equally make a change to a lower-bit representation, it may not be possible to represent slight differences in amplitude. This may result in the deterioration of the sound quality. On the other hand, the second technique cuts off values equal to or less than a particular value, but maintains the other values as they are. This makes it possible to represent slight differences in amplitude.

As described above, the number of bits is reduced on a frequency range basis, using the first technique or the second technique. Specifically, the higher the frequency range, the greater the range of reduction in the number of bits. For example, in the first group and the second group, which are lower frequency ranges, the numbers of bits are reduced by 1, from 5 bits to 4 bits. In the seventh group and the eighth group, which are higher frequency ranges, the numbers of bits are reduced by 3, from 5 bits to 2 bits.

If the number of bits is reduced by 2 or more bits, the process of reducing the number of bits using the first technique or the second technique is performed twice or more. For example, if the number of bits is reduced by 2 bits, from 5 bits to 3 bits, the number of bits is reduced from 5 bits to 4 bits, and is then further reduced from 4 bits to 3 bits. In this case, the first technique may be used to reduce 5 bits to 4 bits, and the first technique may be similarly used, or the second technique may be used, to reduce 4 bits to 3 bits.

It is determined in advance which technique is to be used to perform the process of reducing the number of bits for each group. Further, it is also determined in advance which techniques are to be used in what order. For example, only the first technique may be used for the first through sixth groups, and only the second technique may be used for the seventh group. For the eighth group, in the number-of-bits reduction process performed three times, the first technique may be used at the first and second time, and the second technique may be used at the third time.

It should be noted that, to decompress the compressed audio data, a process opposite to the number-of-bits reduction process using the first technique or the second technique described above is performed in accordance with the technique used to perform the compression. That is, the data compressed using the first technique is decompressed by performing a process opposite to the first technique (for example, doubling the value of each piece of data represented by 4 bits so as to be represented by 5 bits).

As described above, the sample data sequence is divided into eight equal groups, and the number of bits is reduced on a group basis. In a higher frequency range, the range of reduction is greater (from 5 bits to 2 bits). In a lower frequency range, the range of reduction is smaller (from 5 bits to 4 bits). A human being can hear only sounds of frequencies in a certain range. Further, in a higher frequency range and a lower frequency range, a human being may or may not be sensitive to even sounds of frequencies in the audible range. Generally, a high-frequency sound (for example, 10 kHz) is difficult to hear, and therefore, even the compression of data with reduced accuracy of the high-frequency sound may make it unlikely that the sound quality deteriorates. Further, a human being is sensitive to a low-frequency sound (for example, 1 kHz), and therefore, it is preferable to allow a highly accurate reconstruction of the low-frequency sound. Thus, in the exemplary embodiment, in a higher frequency range, the range of reduction in the number of bits is increased to significantly reduce the amount of data. In a lower frequency range, the range of reduction in the number of bits is reduced to allow a highly accurate reconstruction of the data.

As described above, in the number-of-bits reduction process on a frequency range basis, the number of bits of each piece of sample data is reduced by varying the range of reduction on a frequency range basis. The number-of-bits reduction process using the first technique and the second technique is an irreversible conversion. Thus, if the process is performed on data using these techniques, it is not possible to accurately reconstruct the data before being subjected to the process. It does not, however, matter even if it is not possible to accurately reconstruct the data, so long as the sound quality is not affected.

It should be noted that the process of reducing the number of bits may be, as well as the first technique and the second technique, another technique. The other technique may be an irreversible conversion or a reversible conversion.

(Details of Block Optimization Process)

Next, details of the block optimization process in step S109 are described. The block optimization process in step S109 is the process of dividing the sample data sequence into a plurality of blocks (see FIG. 16), and is the process of compressing each block while optimizing it.

That is, in the block optimization process in step S109, the sample data sequence is divided into a plurality of blocks by neglecting the separation positions of the eight equal groups divided in the number-of-bits reduction process on a frequency range in the above step S108. Then, compression is performed on a block basis. Specifically, in the block optimization process, blocks are generated in the data sequence, subjected to the process of step S108, on the basis of the number of bits of each piece of data.

Figure 21:
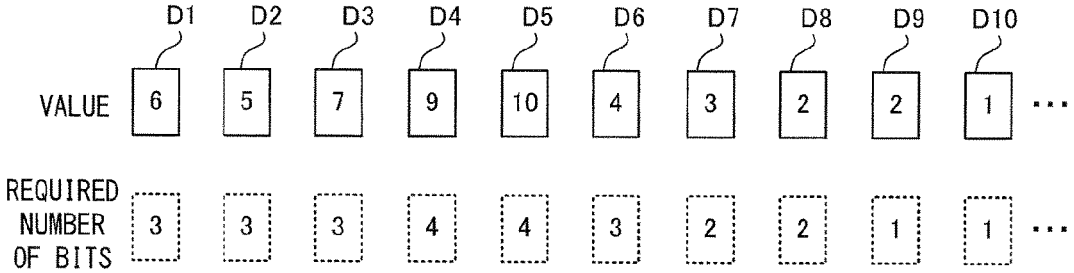
FIG. 21 is a diagram showing a non-limiting example of the values of a data sequence and the number of bits required to represent the values.

FIG. 21 is a diagram showing the values of the data sequence and the number of bits required to represent the values. As shown in FIG. 21, after the process of step S108 is performed, data D1, data D2, data D3, . . . , and data DN are temporarily stored as the data sequence in a memory. At this time, for example, the data D1 through D10 have been subjected to the process as the first group in step S108, and, as a result, compressed so as to be represented by 4 bits. That is, as the regions for storing the values of the data D1 through D10, regions each having 4 bits are secured in the memory.

Meanwhile, as shown in FIG. 21, the value of, for example, the data D1 is "6" (the decimal representation), and the number of bits required to represent the value is "3" (the values that can be represented by 3 bits are 0 to 7). If a region having 3 bits is secured, it is possible to represent the data D1. That is, if the number of bits required to represent a piece of data is secured, the other bits are unnecessary.

Accordingly, in the block optimization process, with attention focused on the number of bits required to represent each piece of data, pieces of data having the same number of bits are assembled in one group. Further, even when pieces of data do not have the same numbers of bits, the pieces of data are assembled in one group if satisfying a predetermined condition. With reference to a flow chart shown in FIG. 8, details of the block optimization process are described below.

Figure 8:
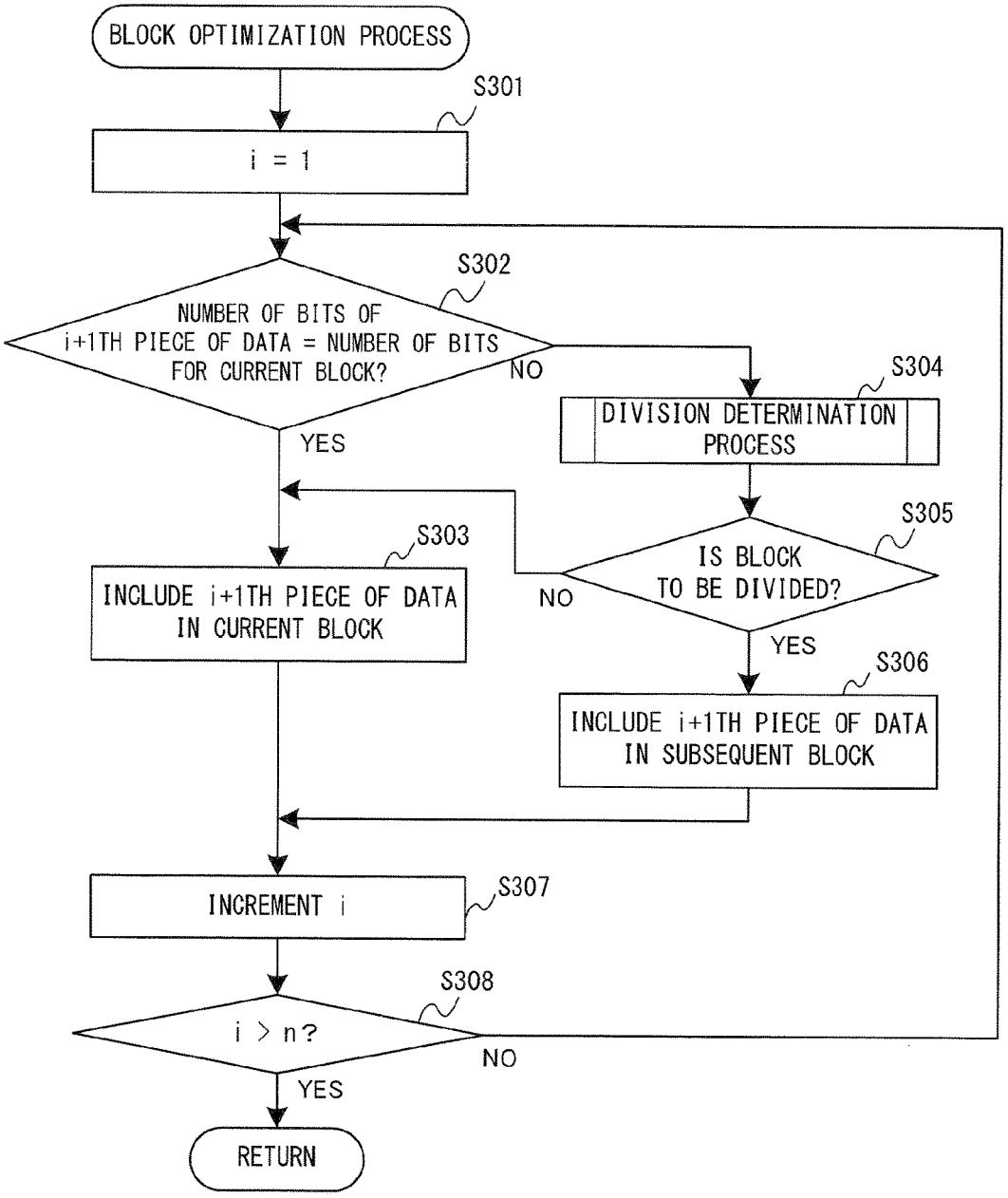
FIG. 8 is a flow chart showing a non-limiting example of details of a block optimization process in step S109.

FIG. 8 is a flow chart showing details of the block optimization process in step S109.

As shown in FIG. 8, the encoding section 13 first sets a variable i to 1 (step S301). The variable i represents the position of a piece of data to be processed. The following processes are performed on an ith piece of sample data of the data sequence.

Next, the encoding section 13 determines whether or not the number of bits of an i+1th piece of data and the number of bits for the current block are equal (step S302). It should be noted that the first piece of data is included in the first block. If the determination result is positive, the encoding section 13 next performs the process of step S303. On the other hand, if the determination result is negative, the encoding section 13 next performs the process of step S304.

In step S303, the encoding section 13 includes the i+1th piece of data in the current block.

Figure 22:
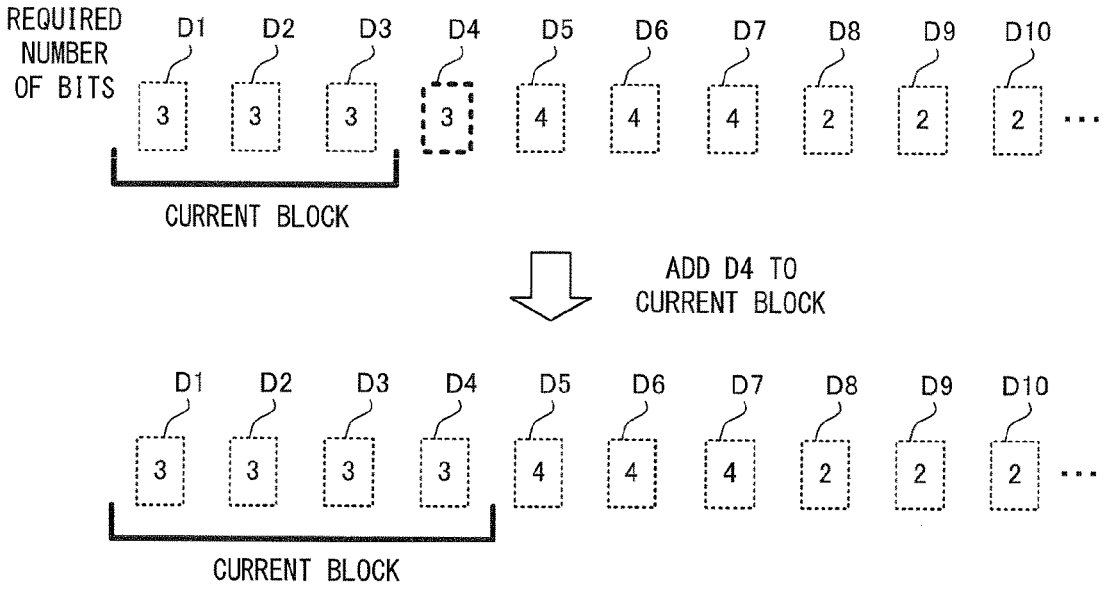
FIG. 22 is a diagram showing a non-limiting example of the state where, if the number of bits of i+1th piece of data and the number of bits for the current block are the same as each other, the i+1th piece of data is included in the current block.

FIG. 22 is a diagram showing the state where, if the number of bits of the i+1th piece of data and the number of bits for the current block are the same as each other, the i+1th piece of data is included in the current block. As shown in FIG. 22, when the numbers of bits of the data D1 through D3 (the numbers of bits required to represent the pieces of data) are "3", if the block optimization process shown in FIG. 8 is performed, the data D1 through D3 are included in the same block (step S303). In this state, if the fourth piece of data, namely the data D4, is subjected to the process shown in FIG. 8, it is determined whether or not the number of bits for the current block and the number of bits of the data D4 are equal (step S302). In the example shown in FIG. 22, both numbers are "3" and equal, and therefore, the data D4 is included in the current block (step S303). As described above, pieces of data whose numbers of bits are equal are included in the current block one after another.

After the process of step S303, the encoding section 13 performs the process of step S307.

On the other hand, in step S304, the encoding section 13 performs a division determination process. Here, the number of bits of the i+1th piece of data and the number of bits for the current block are different from each other, and therefore, the encoding section 13 performs the process of determining whether the i+1th piece of data is to be divided from the current block or included in the current block. With reference to a flow chart shown in FIG. 9, details of the division determination process are described below.

Figure 9:
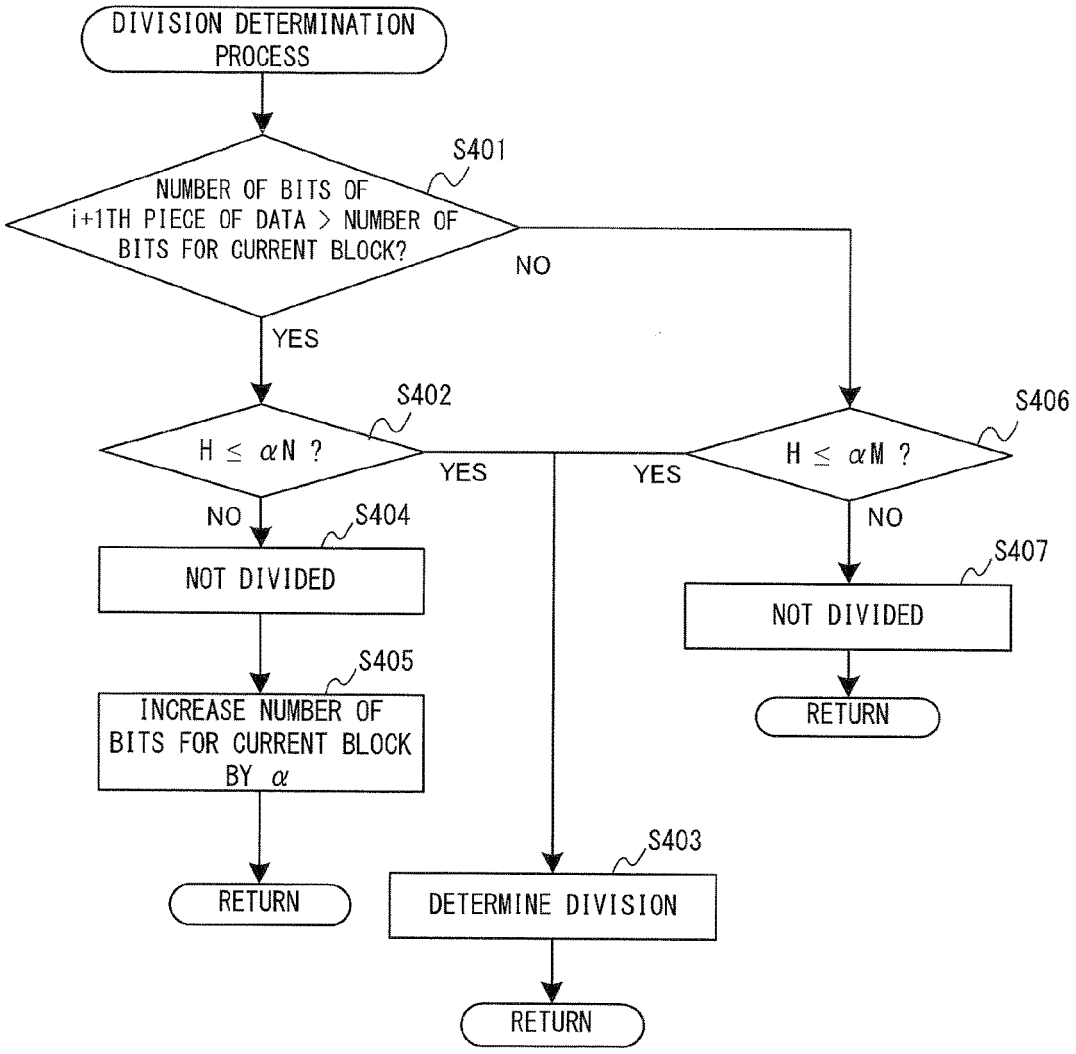
FIG. 9 is a flow chart showing a non-limiting example of details of a division determination process in step S304.

FIG. 9 is a flow chart showing details of the division determination process in step S304.

As shown in FIG. 9, in step S401, the encoding section 13 determines whether or not the number of bits of the i+1th piece of data is greater than the number of bits for the current block. If the determination result is positive (the number of bits of the i+1th piece of data >the number of bits for the current block), the encoding section 13 next performs the process of step S402. On the other hand, if the determination result is negative (the number of bits of the i+1th piece of data <the number of bits for the current block), the encoding section 13 next performs the process of step S406.

In step S402, the encoding section 13 determines whether or not $H \leq \alpha \times N$ holds. Here, "H" represents the size [bits] of the block header BH shown in FIG. 17 described above. Further, "α" represents the difference (an absolute value) between the number of bits for the current block and the number of bits of the i+1th piece of data. Further, "N" represents the number of pieces of data included in the current block.

If the determination result of step S402 is positive ($H \leq \alpha \times N$ holds), the encoding section 13 determines in step S403 that the i+1th piece of data is to be divided from the current block. It should be noted that a description will be given later of the basis for the calculation of the condition for the division ($H \leq \alpha N$) used to determine whether or not the i+1th piece of data is to be divided from the current block.

On the other hand, if the determination result of step S402 is negative ($H \leq \alpha \times N$ does not hold), the encoding section 13 determines in step S404 that the i+1th piece of data is not to be divided from the current block. That is, the encoding section 13 determines that the i+1th piece of data is to be included in the current block. Then, in the subsequent step S405, the encoding section 13 increases the number of bits for the current block by α.

Figure 23:
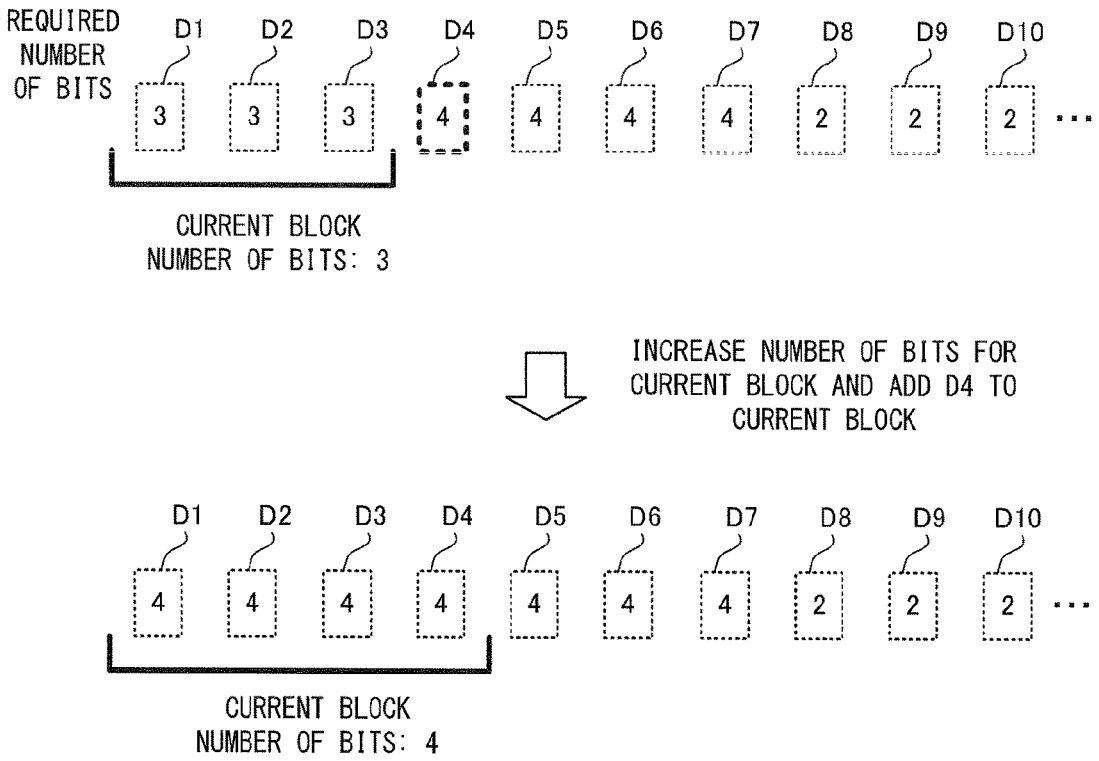
FIG. 23 is a diagram illustrating a non-limiting example of the process of increasing the number of bits for the current block in step S405.

FIG. 23 is a diagram illustrating the process of increasing the number of bits for the current block in step S405. FIG. 23 shows the state where the current block includes the data D1 through D3, and the process is performed on the data D4. As shown in FIG. 23, when the number of bits for the current block (the number of bits of each piece of data included in the block) is "3", if the number of bits of the data D4 is "4", $H \leq \alpha \times N$ does not hold. Thus, it is determined that the data D4 is not to be divided from the current block (step S404). At this time, the number of bits for the current block is increased to the number of bits of the data D4 to be newly added.

Specifically, the number of bits of the data D4 is "4", and therefore, the number of bits for the current block is also increased to "4". Here, "4" bits are required to represent the data D4 to be newly added, and therefore, the number of bits for the current block is also increased in accordance with the number of bits of the data D4 to be newly added. That is, the numbers of bits of the other pieces of data already belonging to the current block are increased in accordance with the number of bits of the data D4 to be newly added. The number of bits for the current block is thus increased in accordance with the number of bits of a piece of data to be newly added, whereby it is possible to maintain the value of each piece of data already belonging to the current block, and also represent the value of the piece of data to be newly added.

As described above, on the basis of whether or not the condition for the division ($H \leq \alpha N$) is satisfied in step S402, it is determined whether or not the i+1th piece of data is to be divided from the current block (whether or not the i+1th piece of data is to be included in the current block).

Figure 24:
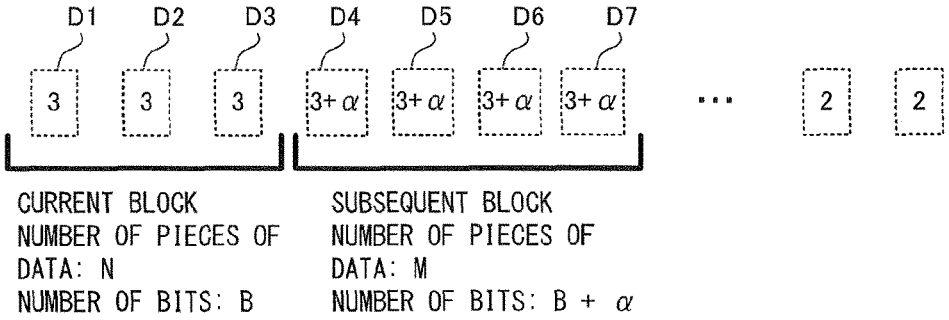
FIG. 24 is a diagram illustrating a non-limiting example of the basis for the calculation of the condition for the division when the number of bits of the i+1th piece of data is greater than the number of bits for the current block.
Figure 24:
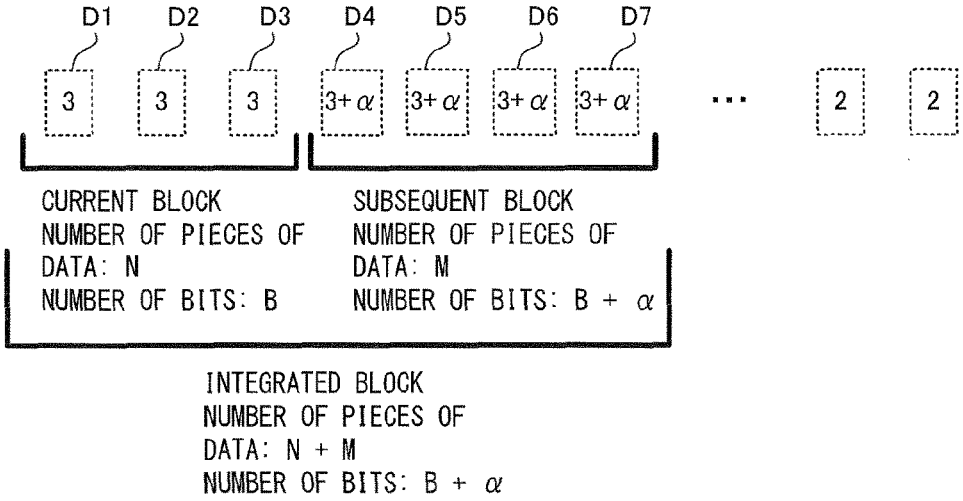

Here, with reference to FIG. 24, the basis for the calculation of the condition for the division in step S402 is described. FIG. 24 is a diagram illustrating the basis for the calculation of the condition for the division when the number of bits of the i+1th piece of data is greater than the number of bits for the current block.

In FIG. 24, it is assumed that the current block is formed by performing the process on the data D1 through D3. It is assumed that the subsequent block is a temporary block obtained by temporarily dividing the data D4 from the current block without including the data D4 in the current block. As shown in FIG. 24, (A) if the current block is divided from the subsequent block: the total size of the two blocks can be calculated by the following formula (1).

$$\text{The total size of the two blocks } (A)=(H+BN)+\{H+M(B+\alpha)\} \quad (1)$$

Here, "B" represents the number of bits for the current block. Further, "M" represents the number of pieces of data included in the subsequent block. Further, as described above, "N" represents the number of pieces of data included in the current block, and "α" represents the difference between the number of bits for the current block and the number of bits for the subsequent block. The data size of the current block is obtained by adding a header to B×N, and therefore is H+BN. Further, the number of bits for the subsequent block is greater than the number of bits B for the current block by α, and the number of pieces of data in the subsequent block is M. Thus, the data size of the subsequent block is H+M (B+α). Thus, the total size of the two blocks can be expressed by the formula (1).

On the other hand, (B) if the current block and the subsequent block are integrated together: the size of the integrated block can be calculated by the following formula (2).

$$\text{The size of the one integrated block } (B)=H+(N+M)(B+\alpha) \quad (2)$$

Here, if the total size of the two blocks (A) is equal to or less than the size of the one integrated block (B), the division into the two blocks results in a smaller data size of the entire data. Thus, the condition for the division is expressed by the following formula (3).

$$(H+BN)+\{H+M(B+\alpha)\}\leq H+(N+M)(B+\alpha) \quad (3)$$

The formula (3) is expanded to obtain the following formula (4) representing the condition for the division.

$$H\leq\alpha N \quad (4)$$

The size H of the block header BH is determined by the frame header FH, and therefore is fixed (here, H=11, for example). Thus, as shown in the formula (4), the condition for the division when the number of bits of the i+1th piece of data is greater than the number of bits for the current block depends on the number of pieces of data N included in the current block and the difference α between the number of bits for the current block and the number of bits of the i+1th piece of data. That is, the condition for the division when the number of bits of the i+1th piece of data is greater than the number of bits for the current block does not depend on the number of pieces of data M included in the subsequent block.

As described above, if the number of bits of the i+1th piece of data is greater than the number of bits for the current block, the encoding section 13 determines, on the basis of whether or not the condition for the division shown in the formula (4) is satisfied, whether or not the i+1th piece of data is to be divided from the current block.

Referring back to FIG. 9, if the determination result of step S401 is negative (the number of bits of the i+1th piece of data <the number of bits for the current block), the encoding section 13 performs the process of step S406.

Specifically, in step S406, the encoding section 13 determines whether or not H≤α×M holds. Here, "M" represents the number of pieces of data included in the subsequent block. Further, "H" is the size (the number of bits) of the block header BH shown in FIG. 17 described above. Further, "α" represents the difference (an absolute value) between the number of bits for the current block and the number of bits of the i+1th piece of data.

If the determination result of step S406 is positive (H≤αM holds), the encoding section 13 determines in step S403 that the i+1th piece of data is to be divided from the current block.

On the other hand, if the determination result of step S406 is negative (H≤αM does not hold), the encoding section 13 determines in step S407 that the i+1th piece of data is not to be divided from the current block (that is, determines that the i+1th piece of data is to be included in the current block).

As described above, on the basis of whether or not the condition for the division (H≤αM) is satisfied in step S406, it is determined whether or not the i+1th piece of data is to be divided from the current block.

The basis for the calculation of the condition for the division (H≤αM) in step S406 is described below.

Figure 25:
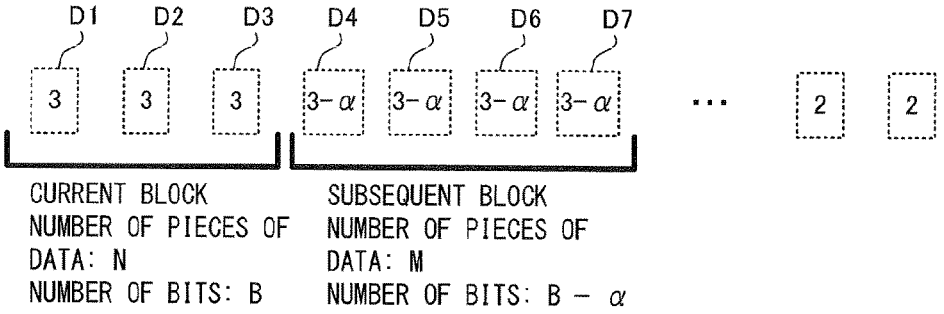
FIG. 25 is a diagram illustrating a non-limiting example of the basis for the calculation of the condition for the division when the number of bits of the i+1th piece of data is smaller than the number of bits for the current block.
Figure 25:
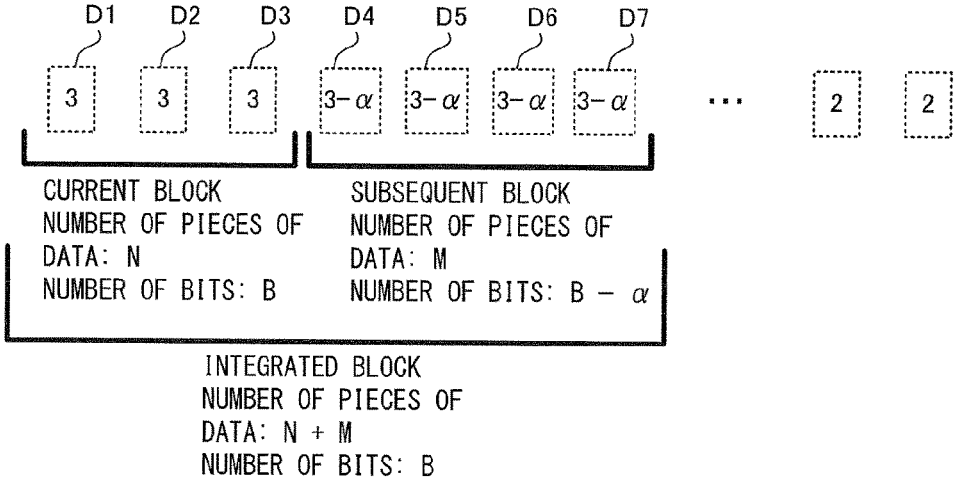

FIG. 25 is a diagram illustrating the basis for the calculation of the condition for the division when the number of bits of the i+1th piece of data is smaller than the number of bits for the current block.

In FIG. 25, it is assumed that, as in FIG. 24, the current block is formed by performing the process on the data D1 through D3, and the subsequent block is a temporary block. As shown in FIG. 25, (C) if the current block is divided from the subsequent block: the total size of the two blocks can be calculated by the following formula (5).

$$\text{The total size of the two blocks } (C)=(H+BN)+\{H+M(B=\alpha)\} \quad (5)$$

Here, "B", "N", and "M" are as described above. The number of bits for the subsequent block is smaller than the number of bits B for the current block by α. Thus, the data size of the subsequent block is H+M(B−α). Thus, the total size of the two blocks can be expressed by the formula (5).

On the other hand, (D) if the current block and the subsequent block are integrated together: the size of the integrated block can be calculated by the following formula (6).

$$\text{The size of the one integrated block } (D)=H+(N+M)B \quad (6)$$

As shown in FIG. 25, if the number of bits of the fourth data D4 is smaller than the number of bits for the current block, it is possible to represent the pieces of data included in the current block and the data D4 through D7 to be newly added to the current block, without increasing the number of bits for the current block. Conversely, if the number of bits for the current block is reduced to the number of bits of the data D4 to be newly added, it is not possible to represent the data D1 through D3 included in the current block. Thus, the number of bits for the integrated block is maintained. Conversely, although the data D4 through D7 to be added can be represented by B−α [bits], regions are secured for B [bits] in the integrated block. As described above, if the number of bits of the data D4 to be newly added is smaller than the number of bits for the current block, the size of the integrated block is, as shown in the formula (6), obtained by adding a header H, and therefore is H+(N+M) B.

Here, if the total size of the two divided blocks (C) is equal to or less than the size of the block when not divided (D), the division into the two blocks results in a smaller data size of the entire data. Thus, the condition for the division is expressed by the following formula (7).

$$(H+BN)+\{H+M(B-\alpha)\}\leq H+(N+M)B \quad (7)$$

The formula (7) is expanded to obtain the following formula (4) representing the condition for the division.

$$H \leq \alpha M \quad (8)$$

The size H of the block header BH is determined by the frame header FH, and therefore is fixed. Thus, as shown in the formula (8), the condition for the division when the number of bits of the i+1th piece of data is smaller than the number of bits for the current block depends on the number of pieces of data M in the subsequent block and the difference α between the number of bits for the current block and the number of bits of the i+1th piece of data.

Here, the number of pieces of data M in the subsequent block is not yet settled at the time of the determination of the condition for the division in step S406. Thus, to settle the number of pieces of data M in the subsequent block, the number of pieces of data M in the subsequent block is calculated by starting the block optimization process from the i+1th piece of data.

Figure 26:
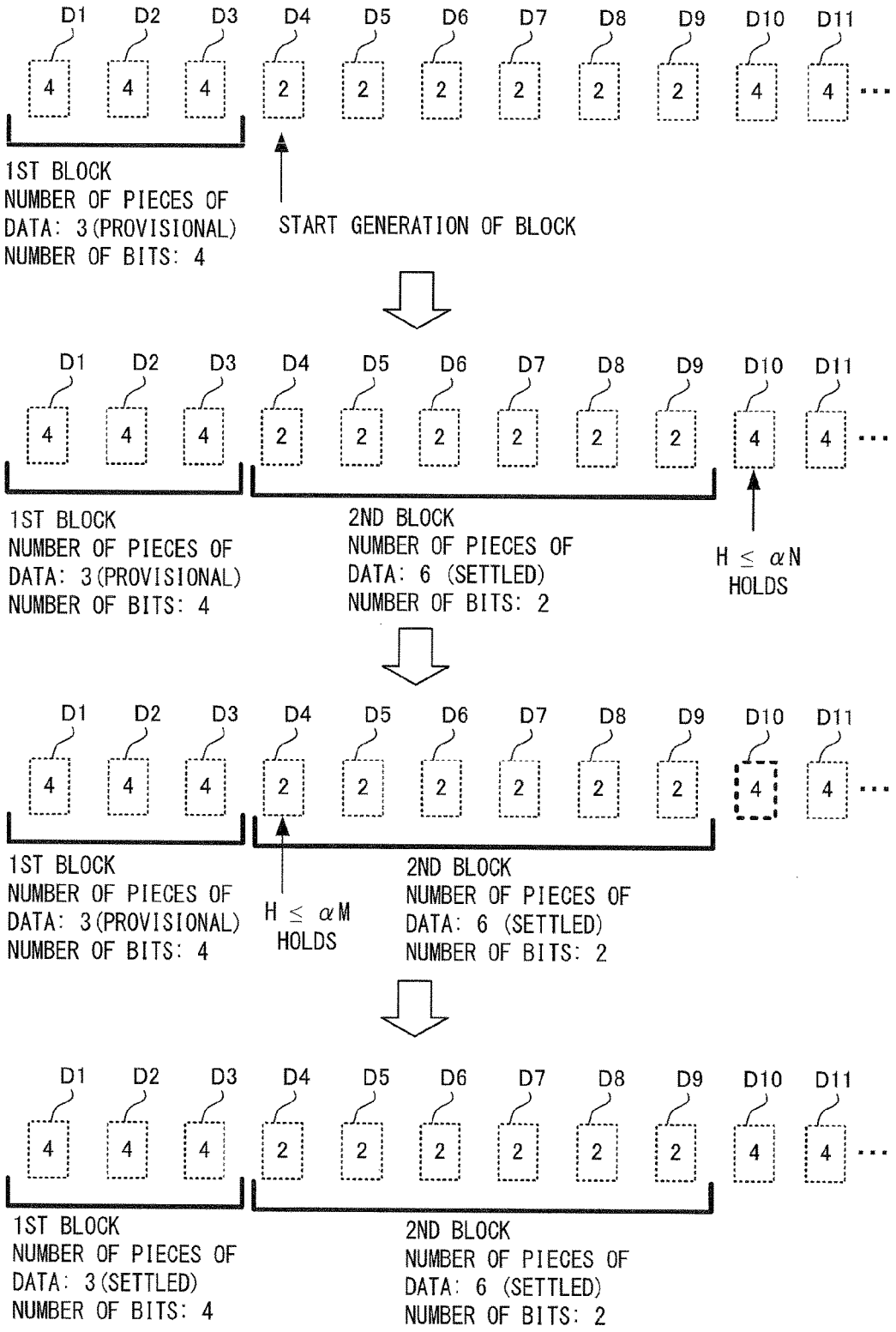
FIG. 26 is a diagram showing a non-limiting example of the state where the number of pieces of data M in the subsequent block is settled, and is a diagram showing a non-limiting example of the state where the current block and the subsequent block are divided from each other.

FIG. 26 is a diagram showing the state where the number of pieces of data M in the subsequent block is settled, and is a diagram showing the state where the current block and the subsequent block are divided from each other. FIG. 26 shows the state where a first block is generated by the data D1 through D3, and the process is to be performed on the data D4 from now. After the first block is generated by the data D1 through D3, the number of bits of the data D4 and the number of bits for the first block are compared with each other, as the process on the data D4.

As shown in FIG. 26, the number of bits of the data D4 is smaller than the number of bits for the first block. In this case, the number of pieces of data M in the subsequent block is required to determine whether or not the data D4 is to be included in the first block. Thus, to settle the number of pieces of data M in the subsequent block, the generation of a new temporary block (a second block) is started from the data D4, while suspending the process of determining whether or not the data D4 is to be included in the first block.

The numbers of bits of the data D4 through D9 are "2" and equal, and therefore, the data D4 through D9 are included in the second block (the above step S303). Next, it is determined whether the data D10 is to be included in the second block, or the data D10 is not to be included in the second block but is to be included in a third block. The number of bits of the data D10 is "4", and the number of bits for the second block is "2". Thus, it is determined in the above step S401 that it is "YES", and it is determined whether or not H≤αN holds (step S402). In the example shown in FIG. 26, α=2, and N (the number of pieces of data in the second block)=6, and therefore, H≤αN holds. Thus, the second block and the data D10 are divided from each other. At this time, the number of pieces of data in the second block is settled to "6". It should be noted that, even at this time, it is not yet determined whether the second block is to be divided from, or integrated with, the first block. Thus, the second block is still a "temporary block".

Since the number of pieces of data M in the second block has thus been settled, the process on the data D4 is restarted. Specifically, it is determined whether or not H≤αM holds. The number of bits for the first block is "4", and the number of bits for the second block is "2". Thus, α=2, and the number of pieces of data M in the second block=6. Thus, H≤αM holds (the condition for the division is satisfied). Consequently, the encoding section 13 determines that the first block and the data D4 are to be divided from each other (S403). That is, the encoding section 13 determines that the first block and the second block are to be divided from each other. It should be noted that, if H≤αM does not hold (the condition for the division is not satisfied), the encoding section 13 integrates the first block and the second block into one block without dividing them, and defines the integrated block as a first block.

As described above, if the number of bits of the subsequent piece of data (the i+1th piece of data) is smaller than the number of bits for the current block, the number of pieces of data in the subsequent block is settled first, and then, it is determined whether or not the i+1th piece of data is to be included in the current block.

It should be noted that, if, in FIG. 26, the number of bits of the data D10 is smaller than the number of bits for the second block (a temporary block), the encoding section 13 further starts the generation of a new block from the data D10, and performs the process of settling the number of pieces of data in the third block (a temporary block). Subsequent blocks are thus provisionally generated, and the numbers of pieces of data to be included in the blocks are sequentially settled.

After the process of step S403, the process of step S405, or the process of step S407, the encoding section 13 ends the division determination process shown in FIG. 9, and returns the processing to FIG. 8.

Referring back to FIG. 8, if, as a result of the division determination process in step S304, it has been determined that the block is to be divided (step S305: YES), the encoding section 13 performs the process of step S306. On the other hand, if it has been determined that the block is not to be divided (step S305: NO), the encoding section 13 next performs the process of step S303.

In step S306, the encoding section 13 includes the i+1th piece of data in the subsequent block. Consequently, the current block is settled, and the subsequent block is newly generated. After this, the process is performed of determining whether or not a piece of data is to be included in the subsequent block.

After the process of step S306, in step S307, the encoding section 13 adds 1 to the variable i. Then, in the subsequent step S308, the encoding section 13 determines whether or not i is greater than n. If the determination result is negative, the encoding section 13 performs the process of step S302 again. If i is greater than n, the encoding section 13 ends the block optimization process shown in FIG. 8.

As described above, the processes of steps S302 through S308 are repeatedly performed, whereby the process on the n pieces of sample data is performed. This results in dividing the frequency domain data sequence into a plurality of blocks, and optimizing each block.

Specifically, taking into account the data size of the entire data including headers when a block is divided and the data size of the entire data including headers when the block is not divided, and on the basis of the condition for obtaining a smaller data size of the entire data, it is determined whether or not the block is to be divided. Then, data is compressed on a divided block basis. More specifically, a block is a set of pieces of data that can be represented by the same number of bits, and the numbers of bits of the pieces of data are reduced after the compression.

As described above, the sample data sequence is divided into a plurality of variable blocks on the basis of the numbers of bits of each piece of data, and extra bits are removed. Although apparent from the above descriptions, the block optimization process in FIG. 8 is a reversible conversion that allows an accurate reconstruction of the value of each piece of sample data, unlike the number-of-bits reduction process on a frequency range basis shown in FIG. 7.

It should be noted that the block optimization process shown in FIG. 8 is performed with respect to each value of the region FH2 of the frame header FH. That is, values of 0 to 3 are set in the region FH2, and the block optimization process is performed with respect to each value. Then, the frame of the smallest size is selected and stored.

Figure 27:
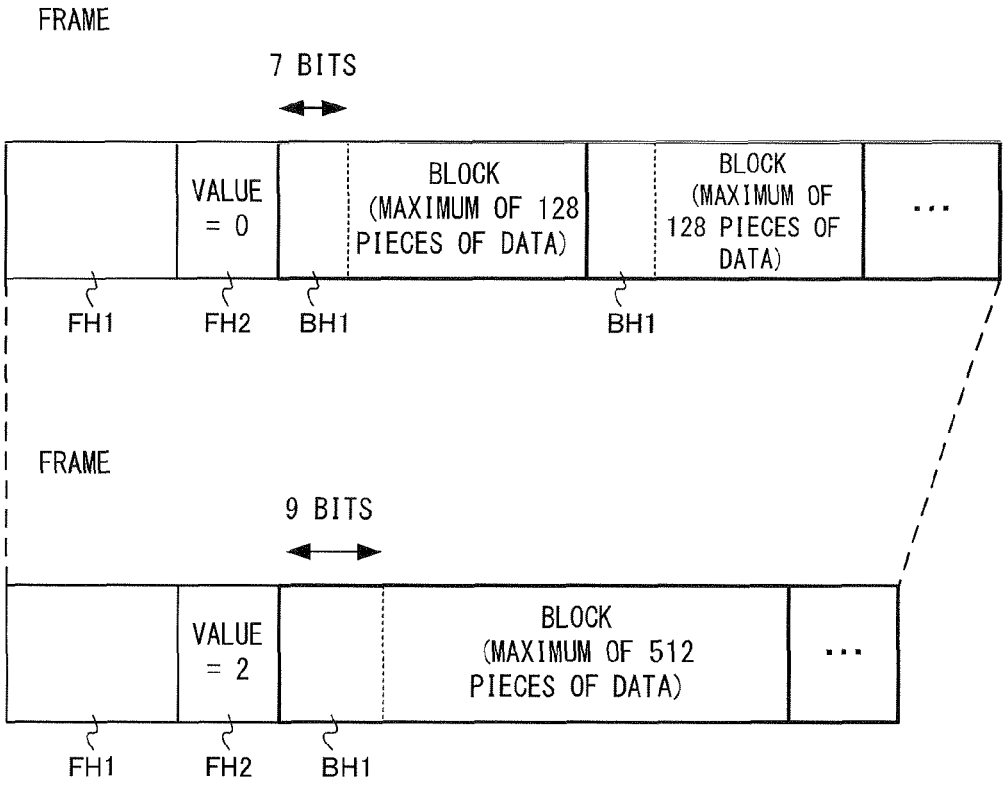
FIG. 27 is a diagram showing a non-limiting example of the difference in data size based on the value set in a region FH2 of a frame header FH.

FIG. 27 is a diagram showing the difference in data size based on the value set in the region FH2 of the frame header FH. As shown in FIG. 27, if a value of 0 is set in the region FH2, it is determined that the maximum number of pieces of data to be included in each block is 128. If a value of 2 is set in the region FH2, it is determined that the maximum number of pieces of data to be included in each block is 512. At this time, as shown in FIG. 27, if the maximum numbers of pieces of data to be included in blocks are different, the size of the entire frame may vary when the data is compressed.

Thus, in the exemplary embodiment, each value (0 to 3) is set in the region FH2 of the frame header FH, and the data is compressed. Then, with respect to each value, the frame of the smallest data size of the compressed data is selected.

(Decoding Process)

Figure 28:
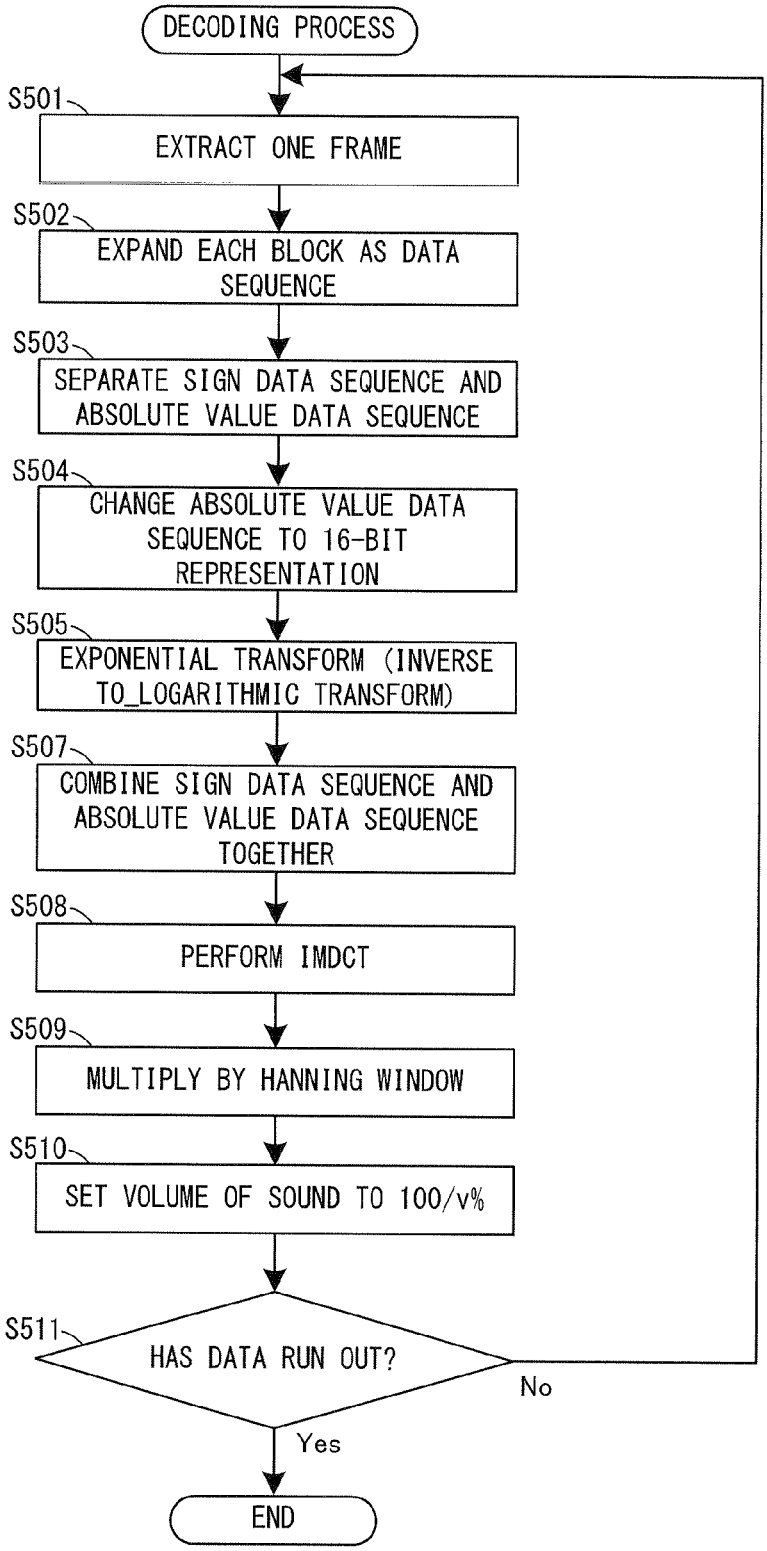
FIG. 28 is a flow chart showing a non-limiting example of the flow of a decoding process performed by a decoding section 15.

Next, a description is given of the process of decoding the compressed data that has been compressed as described above. The decoding process is a process opposite to the encoding process described above. That is, the data compressed and stored in the encoding process is loaded on a frame basis, and is subjected to a process opposite to the process described above. FIG. 28 is a flow chart showing the flow of the decoding process performed by the decoding section 15.

As shown in FIG. 28, the decoding section 15 first extracts one frame from the compressed data storage section 14 (step S501). Subsequently, the decoding section 15 obtains pieces of data in each block included in the extracted frame, and expands the pieces of data as one data sequence (step S502).

Specifically, the decoding section 15 reads values stored in the region FH1 and the region FH2 of the frame header FH to specify the size of the frame, and also specify the number of bits for "the number of samples" of the block headers BH. The size of each block header BH is specified on the basis of the specified number of bits for the number of samples. The decoding section 15 reads the block header BH of a beginning block to specify the number of pieces of sample data included in the beginning block, and also specify the number of bits of each piece of sample data in the beginning block. Then, the decoding section 15 extracts each piece of sample data included in the beginning block. Further, the decoding section 15 can specify the separation position of the subsequent block on the basis of the number of pieces of sample data in the beginning block and the number of bits of each piece of sample data in the beginning block. The above process is repeatedly performed from the beginning block to the last block, whereby the decoding section 15 can extract all the pieces of sample data (the n pieces of frequency domain data) included in the frame, and expand the pieces of sample data as a data sequence.

Next, in step S503, the decoding section 15 separates the data sequence obtained in the process of step S502 into a sign data sequence and an absolute value data sequence. Then, the decoding section 15 changes the separated absolute value data sequence to a 16-bit representation (step S504). Here, a process opposite to the encoding process is performed, whereby each piece of data is represented by 16 bits.

Next, in step S505, the decoding section 15 exponentially transforms each piece of obtained absolute value data. That is, a process opposite to the logarithmic transform in step S106 of FIG. 6 is performed. Subsequently, in step S507, the decoding section 15 combines the separated sign data sequence and absolute value data sequence together.

Next, in step S508, the decoding section 15 performs an IMDCT (Inverse MDCT; inverse modified discrete cosine transform). Consequently, the frequency domain data is converted into time domain data. Subsequently, the decoding section 15 multiplies the obtained time domain data by a Hanning window (step S509). Then, the decoding section 15 sets the volume of the sound to 100/v % (step S510). As described above, the decoding process is performed on the one frame.

Subsequently, the decoding section 15 determines whether or not data has run out in the compressed data storage section 14 (step S511). If data has run out, the decoding section 15 ends the decoding process of FIG. 28. If data has not run out, the decoding section 15 performs the process of step S501 again.

As described above, the processes of steps S501 through S511 are repeatedly performed, whereby the compressed data that has been compressed is decompressed and output as a sound.

It should be noted that the processes of all the steps in the flow charts shown in FIGS. 6 through 9 and FIG. 28 are merely illustrative. Thus, the processing order of the steps may be changed so long as similar results are obtained. Further, the values used in all the steps are merely illustrative, and therefore, any value may be used. Further, in the exemplary embodiment, descriptions are given on the assumption that the CPU of the data compression/decompression apparatus 10 performs the processes of all the steps in the flow charts. Alternatively, a processor or a dedicated circuit other than the CPU may perform the processes of some or all of the steps in the flow charts.

As described above, in the exemplary embodiment, a frequency domain data sequence is divided into a plurality of variable blocks, and each block is compressed. This makes it possible to generate blocks more preferable for data compression, and compress data. Specifically, taking into account the size of block headers increased when a block is divided, it is determined whether or not the block is to be divided. If the division results in a smaller data size, the block is divided. This makes it possible to obtain a smaller size of the entire data when compressed.

In addition, in the exemplary embodiment, blocks are generated on the basis of the number of bits of each piece of data, and unnecessary bits of each piece of data in each block are removed, thereby compressing the data. This makes it possible to assemble a plurality of pieces of data in a block by simple calculations, and compress the data. Further, in the block optimization process according to the exemplary embodiment, only unnecessary bits are removed so as to leave necessary bits, which allows a reversible compression of the data.

In addition, in the exemplary embodiment, in the number-of-bits reduction process on a frequency range basis, the range of reduction in the number of bits varies in accordance with the frequency range. This makes it possible to reconstruct data in a specific frequency range with high accuracy where necessary, and also compress data in the other frequency ranges with a high compression ratio. As described above, it is possible to prevent the deterioration of data while improving the compression ratio of the entire data.

In addition, in the exemplary embodiment, in the number-of-bits reduction process on a frequency range basis, the number of bits is reduced using any of a plurality of techniques (the first technique and the second technique). This makes it possible to, for example, compress data using a technique that has a smaller effect on the data when decoded.

In addition, in the exemplary embodiment, an evaluation is made of whether or not a block is to be divided (the determination of the condition for the division), and the block is divided on the basis of the evaluation. This makes it possible to, for example, divide a block by a method that results in a smaller size.

In addition, in the exemplary embodiment, not only is data compressed after the conversion of an audio signal from time domain data to frequency domain data, but also the time domain data is compressed before being converted into the frequency domain data (the above step S102). This makes it possible to further increase the compression ratio.

As described above, in the exemplary embodiment, it is possible to compress, for example, a sound. For example, it is particularly effective if the compression method according to the exemplary embodiment is used for an audio signal of a human voice. A large amplitude has a larger tendency to appear only in a partial frequency range (a portion that is not a high-frequency range) when an audio signal of a human voice is converted into frequency domain data, than when an audio signal of music or the like is converted into frequency domain data. Further, in the case of a human voice, an amplitude tends to be relatively small in a high-frequency range. Thus, as a result, it is likely that pieces of data belong to the same block, which increases the compression efficiency. That is, in the case of a human voice, it is likely that pieces of data that can be represented by a small number of bits appear in a high-frequency range, and a block having a high compression ratio (a block having a large number of pieces of data and a small number of bits) is generated.

It should be noted that the data compression method described above can be performed by any information processing apparatus.

For example, examples of any information processing apparatus may include personal computers, servers, smartphones, mobile phones, PDAs, game apparatuses, and tablet computers. Further, a system including such a plurality of apparatuses connected together may perform the encoding process and the decoding process described above.

While certain example systems, methods, devices and apparatuses have been described herein, it is to be understood that the appended claims are not to be limited to the systems, methods, devices and apparatuses disclosed, but on the contrary, are intended to cover various modifications and equivalent arrangements included within the spirit and scope of the appended claims.

What is claimed is:

1. A data compression apparatus for compressing a plurality of pieces of input data to generate compressed data, the data compression apparatus comprising:

a processing system that includes at least one processor coupled to a memory, the processing system configured to:

acquire input data that is separated into a plurality of pieces;

determine that values of two adjacent ones of the plurality of pieces of input data are representable by the same required number of bits;

based on the number of bits required to represent values of the plurality of pieces of input data, generate a plurality of blocks such that each of the plurality of pieces of input data is included in any one of the plurality of blocks, where the pieces of input data for each one of the plurality of blocks is stored using a number of bits for the corresponding block, wherein the two adjacent ones of the plurality of pieces of input data are included in the same one of the plurality of blocks that are generated based on the determination, where pieces of input data for at least two of the blocks of the plurality of blocks are stored using a different number of bits;

compress, on a block basis, the pieces of input data included in the generated blocks, thereby generating the compressed data; and output the compressed data to a memory storage medium.

2. The data compression apparatus according to claim 1, wherein the plurality of blocks are generated by, on the basis of the required numbers of bits, separating a data sequence in which the plurality of pieces of input data are arranged.

3. The data compression apparatus according to claim 1, wherein the pieces of input data included in each block are compressed by removing unnecessary bits so as to leave bits required to represent the values of the pieces of input data included in the block.

4. The data compression apparatus according to claim 1, wherein if the required numbers of bits of adjacent pieces among the pieces of input data are the same, the adjacent pieces of input data are included in the same block.

5. The data compression apparatus according to claim 4, wherein even when the required numbers of bits of adjacent pieces among the pieces of input data are different from each other, if the adjacent pieces of input data satisfy a predetermined condition, the adjacent pieces of input data are included in the same block.

6. The data compression apparatus according to claim 1, wherein if a data size of the compressed data compressed by including adjacent pieces among the pieces of input data in two different blocks is smaller than the data size of the compressed data compressed by including the adjacent pieces of input data in one block, the adjacent pieces of input data are included in the two different blocks to generate two blocks.

7. The data compression apparatus according to claim 1, wherein on the basis of the required numbers of bits, decompression information used to decompress the compressed data is generated on a block basis, thereby generating the compressed data including the decompression information.

8. The data compression apparatus according to claim 7, wherein on the basis of the required numbers of bits, bit information indicating the number of bits of each of the pieces of input data included in each block is set as the decompression information, and the number of bits of each of the pieces of input data included in the block is compressed to the number of bits indicated by the bit information, thereby generating the compressed data.

9. The data compression apparatus according to claim 8, wherein on the basis of a difference between the required number of bits of one of the pieces of input data adjacent to one of the blocks and the number of bits indicated by the bit information regarding the block, it is determined whether the adjacent piece of input data is to be included in the block to generate one block, or the adjacent piece of input data is to be included in a different one of the blocks to generate two blocks.

10. The data compression apparatus according to claim 9, wherein on the basis also of a size of the decompression information, it is determined whether the piece of input data adjacent to the block is to be included in the block to generate one block, or the adjacent piece of input data is to be included in the different block to generate two blocks.

11. The data compression apparatus according to claim 10, wherein when the required number of bits of the adjacent piece of input data is greater than the number of bits indicated by the bit information regarding the block, if a product of the difference and the number of pieces of input data included in the block is smaller than the size of the decompression information, the adjacent piece of input data is included in the block.

12. The data compression apparatus according to claim 11, wherein when the required number of bits of the adjacent piece of input data is greater than the number of bits indicated by the bit information regarding the block, if the adjacent piece of input data is to be included in the block, the number of bits indicated by the bit information regarding the block is increased.

13. The data compression apparatus according to claim 9, wherein when the required number of bits of the adjacent piece of input data is smaller than the number of bits indicated by the bit information regarding the block, if a product of the difference and the number of pieces of input data included in the different block is smaller than the size of the decompression information, the adjacent piece of input data is included in the block.

14. The data compression apparatus according to claim 1, wherein the processing system is further configured to, before the pieces of input data are compressed, reduce the numbers of bits of the plurality of pieces of input data to predetermined values.

15. The data compression apparatus according to claim 1, wherein the processing system is further configured to logarithmically transform original data to generate the pieces of input data, and a plurality of blocks are generated such that each of the pieces of generated input data is included in any one of the plurality of blocks.

16. The data compression apparatus according to claim 1, wherein the plurality of pieces of input data are audio data obtained by performing analog-to-digital conversion on an audio signal.

17. The data compression apparatus according to claim 1, wherein the processing system is further configured to convert a plurality of pieces of time domain data obtained by sampling an audio signal with a predetermined period, into a plurality of pieces of frequency domain data, and a plurality of blocks are generated such that, as the plurality of pieces of input data, each of the plurality of pieces of frequency domain data is included in any one of the plurality of blocks.

18. A data decompression apparatus for decompressing decompression target data that is based on input data that is compressed, the decompression target data including a plurality of blocks that each include a plurality of pieces of compressed data and information indicating the number of bits used to represent each piece of compressed data included in the block, wherein blocks are generated based on determination that the input data includes adjacent pieces of input data, of a plurality of pieces of the input data, that are representable by the same required number of bits, the adjacent pieces of input data being included in the same block that is compressed for the decompression target data, where at least two of the blocks of the plurality of blocks have information indicating a different number of bits, the data decompression apparatus comprising:

a processing system that includes at least one processor coupled to a memory, the processing system configured to:

load the compressed data from the memory storage medium;

on the basis of the information indicating the number of bits of each of the pieces of compressed data, extract the plurality of pieces of compressed data included in the block, wherein adjacent ones of the plurality of pieces of compressed data in the block are represented by the same number of bits for those pieces of compressed data in the block; and decompress the pieces of extracted compressed data; and output the decompressed data to a computer readable medium.

19. A non-transitory computer-readable storage medium having stored therein a data compression program to be executed by a computer of a data compression apparatus for compressing a plurality of pieces of input data to generate compressed data, the data compression program comprising instructions that are configured to cause the computer to:

acquire input data that is separated into a plurality of pieces;

determine that values of two adjacent ones of the plurality of pieces of input data are representable by the same required number of bits;

based on the number of bits required to represent values of the plurality of pieces of input data, generate a plurality of blocks such that each of the plurality of pieces of input data is included in any one of the plurality of blocks, where the pieces of input data for each one of the plurality of blocks is stored using a number of bits for the corresponding block, wherein the two adjacent ones of the plurality of pieces of input data are included in the same one of the plurality of blocks that are generated based on the determination, where pieces of input data for at least two of the blocks of the plurality of blocks are stored using a different number of bits; and compress, on a block basis, the pieces of input data included in the generated blocks, thereby generating the compressed data; and output the compressed data to a memory storage medium.

20. A data compression system for compressing a plurality of pieces of input data to generate compressed data, the data compression system comprising a processing system that includes at least one processor coupled to a memory, the processing system configured to:

acquire input data that is separated into a plurality of pieces;

determine that values of two adjacent ones of the plurality of pieces of input data are representable by the same required number of bits;

based on the number of bits required to represent values of the plurality of pieces of input data, generate a plurality of blocks such that each of the plurality of pieces of input data is included in any one of the plurality of blocks, where the pieces of input data for each one of the plurality of blocks is stored using a number of bits for the corresponding block, wherein the two adjacent ones of the plurality of pieces of input data are included in the same one of the plurality of blocks that are generated based on the determination, where pieces of input data for at least two of the blocks of the plurality of blocks are stored using a different number of bits;

compress, on a block basis, the pieces of input data included in the generated blocks, thereby generating the compressed data;

output the compressed data to a memory storage medium.

21. A data compression method to be performed by a data compression system for compressing a plurality of pieces of input data to generate compressed data, the data compression system comprising at least one processor coupled to a memory, the data compression method executing on the data compression system and comprising:

acquiring input data that is separated into a plurality of pieces;

determining that values of two adjacent ones of the plurality of pieces of input data are representable by the same required number of bits;

based on the number of bits required to represent values of the plurality of pieces of input data, generating a plurality of blocks such that each of the plurality of pieces of input data is included in any one of the plurality of blocks, where the pieces of input data for each one of the plurality of blocks is stored using a number of bits for the corresponding block, wherein the two adjacent ones of the plurality of pieces of input data are included in the same one of the plurality of blocks that are generated based on the determination, where pieces of input data for at least two of the blocks of the plurality of blocks are stored using a different number of bits;

compressing, on a block basis, the pieces of input data included in the generated blocks, thereby generating the compressed data; and outputting the compressed data to a memory storage medium.

22. A data decompression system for decompressing decompression target data that is based on input data that is compressed, the decompression target data including a plurality of blocks that each include a plurality of pieces of compressed data and information indicating the number of bits used to represent each piece of compressed data included in the block, wherein blocks are generated based on determination that the input data includes adjacent pieces of input data, of a plurality of pieces of the input data, that are representable by the same required number of bits, the adjacent pieces of input data being included in the same block that is compressed for the decompression target data, where at least two of the blocks of the plurality of blocks have information indicating a different number of bits, the data decompression system comprising:

a processing system that includes at least one processor coupled to a memory, the processing system configured to:

load the compressed data from the memory storage medium;

on the basis of the information indicating the number of bits of each of the pieces of the compressed data, extract the plurality of pieces of compressed data included in the block, wherein adjacent ones of the plurality of pieces of compressed data in the block are represented by the same number of bits for those pieces of compressed data in the block; and decompress the pieces of extracted compressed data; and output the decompressed data to a computer readable medium.

23. A data compression/decompression system for compressing a plurality of pieces of input data to generate compressed data and decompressing the compressed data, the data compression/decompression system comprising a processing system that includes at least one processor coupled to a memory, the processing system configured to:

acquire input data that is separated into a plurality of pieces;

determine that values of two adjacent ones of the plurality of pieces of input data are representable by the same required number of bits;

based on the number of bits required to represent values of the plurality of pieces of input data, generate a plurality of blocks such that each of the plurality of pieces of input data is included in any one of the plurality of blocks, where the pieces of input for each one of the plurality of blocks is stored using a number of bits for the corresponding block, wherein the two adjacent ones of the plurality of pieces of input data are included in the same one of the plurality of blocks that are generated based on the determination, where pieces of input data for at least two of the blocks of the plurality of blocks are stored using a different number of bits;

compress, on a block basis, the pieces of input data included in the generated blocks and generate information indicating the number of bits of each of the pieces of data included in the block, thereby generating the compressed data;

store the compressed data to a memory storage medium;

load the compressed data from the memory storage medium;

on the basis of the information indicating the number of bits of each of the pieces of data, extract the plurality of pieces of compressed data included in the block; and decompress the pieces of extracted compressed data.

* * * * *